US008959951B2

(12) United States Patent
Fujimoto et al.

(10) Patent No.: US 8,959,951 B2
(45) Date of Patent: Feb. 24, 2015

(54) REFRIGERATION APPARATUS CONTROLLING OPENING DEGREE OF A SECOND EXPANSION MECHANISM BASED ON AIR TEMPERATURE AT THE EVAPORATOR OR REFERGERANT TEMPERATURE AT THE OUTLET OF A TWO STAGE COMPRESSION ELEMENT

(75) Inventors: Shuji Fujimoto, Sakai (JP); Atsushi Yoshimi, Sakai (JP); Takahiro Yamaguchi, Sakai (JP); Toru Inazuka, Sakai (JP); Kazuhiro Furusho, Sakai (JP); Mitsuharu Uchida, Kusatsu (JP); Hidehiko Kataoka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 833 days.

(21) Appl. No.: 12/989,863

(22) PCT Filed: Apr. 30, 2009

(86) PCT No.: PCT/JP2009/001953

§ 371 (c)(1),
(2), (4) Date: Oct. 27, 2010

(87) PCT Pub. No.: WO2009/133706

PCT Pub. Date: Nov. 5, 2009

(65) Prior Publication Data

US 2011/0036119 A1 Feb. 17, 2011

(30) Foreign Application Priority Data

May 2, 2008 (JP) ..... 2008-120739

(51) Int. Cl.
*F25B 1/10* (2006.01)
*F25B 43/00* (2006.01)

(Continued)

(52) U.S. Cl.
CPC . *F25B 9/008* (2013.01); *F25B 1/10* (2013.01); *F25B 13/00* (2013.01); *F25B 40/00* (2013.01);

(Continued)

(58) Field of Classification Search
USPC ..... 62/510, 512–513, 223–225
See application file for complete search history.

(56) References Cited

U.S. PATENT DOCUMENTS 5,095,712 A * 3/1992 Narreau ..... 62/113
6,474,087 B1 * 11/2002 Lifson ..... 62/199

(Continued)

FOREIGN PATENT DOCUMENTS

EP 1 684 027 A2 7/2006
JP 2-73562 U 6/1990

(Continued)

OTHER PUBLICATIONS

International Search Report of corresponding PCT Application No. PCT/JP2009/001953.

(Continued)

*Primary Examiner* — Frantz Jules
*Assistant Examiner* — Joseph Trpisovsky
(74) *Attorney, Agent, or Firm* — Global IP Counselors

(57) ABSTRACT

A refrigerating apparatus, where refrigerant reaches a supercritical state in at least part of a refrigeration cycle, includes at least one expansion mechanism, an evaporator connected to the expansion mechanism, first and second sequential compression elements, a radiator connected to the discharge side of the second compression element, a first refrigerant pipe interconnecting the radiator and the expansion mechanism, a heat exchanger arranged to cause heat exchange between the first refrigerant pipe and another refrigerant pipe. Preferably, a heat exchanger switching mechanism is switchable so that refrigerant flows in the first refrigerant pipe through the first heat exchanger or in a heat exchange bypass pipe connected to the first refrigerant pipe. Alternatively, a heat exchanger switching mechanism increases refrigerant flowing through a second expansion mechanism when an air temperature at the evaporator and/or a compressed refrigerant temperature detected is higher and/or lower than predetermined values.

14 Claims, 20 Drawing Sheets

(51) Int. Cl.

| | |
|---|---|
| ***F25B 41/00*** | (2006.01) |
| ***F25B 39/02*** | (2006.01) |
| ***F25B 9/00*** | (2006.01) |
| ***F25B 13/00*** | (2006.01) |
| ***F25B 40/00*** | (2006.01) |

(52) U.S. Cl.

CPC . *F25B 2309/061* (2013.01); *F25B 2313/02741* (2013.01); *F25B 2400/13* (2013.01); *F25B 2600/2507* (2013.01)

USPC ..... 62/510; 62/512; 62/513; 62/223; 62/224; 62/225

(56) References Cited

U.S. PATENT DOCUMENTS

| | | | | |
|---|---|---|---|---|
| 2004/0216477 | A1* | 11/2004 | Yamasaki et al. | 62/216 |
| 2005/0262859 | A1 | 12/2005 | Crane et al. | |
| 2006/0080989 | A1* | 4/2006 | Aoki et al. | 62/324.4 |
| 2006/0086110 | A1* | 4/2006 | Manole | 62/175 |
| 2006/0168997 | A1* | 8/2006 | Imai et al. | 62/513 |
| 2006/0191288 | A1* | 8/2006 | Radermacher et al. | 62/510 |
| 2007/0193290 | A1* | 8/2007 | Ebara | 62/238.6 |
| 2008/0245505 | A1 | 10/2008 | Yamaguchi et al. | |
| 2009/0205355 | A1 | 8/2009 | Mihara | |
| 2010/0077777 | A1* | 4/2010 | Lifson et al. | 62/117 |
| 2010/0199694 | A1* | 8/2010 | Taras et al. | 62/117 |
| 2010/0326100 | A1* | 12/2010 | Taras et al. | 62/115 |

FOREIGN PATENT DOCUMENTS

| | | | |
|---|---|---|---|
| JP | 2004-293815 | A | 10/2004 |
| JP | 2007-232263 | A | 9/2007 |
| WO | 2007/046332 | A1 | 4/2007 |
| WO | WO-2007/119372 | A1 | 10/2007 |

OTHER PUBLICATIONS

International Preliminary Report of corresponding PCT Application No. PCT/JP2009/001953.

European Search Report of corresponding EP Application No. 09 73 8643.7 dated Aug. 12, 2014.

* cited by examiner

REFRIGERATION APPARATUS CONTROLLING OPENING DEGREE OF A SECOND EXPANSION MECHANISM BASED ON AIR TEMPERATURE AT THE EVAPORATOR OR REFERGERANT TEMPERATURE AT THE OUTLET OF A TWO STAGE COMPRESSION ELEMENT

CROSS-REFERENCE TO RELATED APPLICATION

This U.S. National stage application claims priority under 35 U.S.C. §119(a) to Japaneses Patent Application No. 2008-120739, filed in Japan on May 2, 2008, the entire contents of which are hereby incorporated herein by reference.

TECHNICAL FIELD

The present invention relates to a refrigerating apparatus and particularly to a refrigerating apparatus that performs a multistage compression refrigeration cycle using a refrigerant that works including the process of a supercritical state.

BACKGROUND ART

Conventionally, as one of refrigerating apparatus that perform a multistage compression refrigeration cycle using a refrigerant that works in a supercritical region, there is an air conditioning apparatus such as described in Japanese Patent Publication No. 2007-232263 that performs a two-stage compression refrigeration cycle using carbon dioxide as the refrigerant. This air conditioning apparatus mainly has a compressor having two compression elements connected in series, an outdoor heat exchanger, an expansion valve, and an indoor heat exchanger.

SUMMARY

Technical Problem

In the above-described air conditioning apparatus, consideration relating to maintaining the coefficient of performance when the load of the refrigerating apparatus has fluctuated is not given.

Further, there is also the fear that simply improving the coefficient of performance in correspondence to load fluctuations will end up increasing the load on devices.

It is a problem of the present invention to provide, in a refrigerating apparatus using a refrigerant that works including the process of a supercritical state, a refrigerating apparatus whose coefficient of performance can be improved while maintaining device reliability even when its load fluctuates.

Solution to the Problem

A refrigerating apparatus of a first aspect of the invention is a refrigerating apparatus where a working refrigerant reaches a supercritical state in at least part of a refrigeration cycle, the refrigerating apparatus comprising an expansion mechanism, an evaporator, a two-stage compression element, a radiator, first refrigerant pipe, second refrigerant pipe, a first heat exchanger, a first heat exchange bypass pipe, and a heat exchanger switching mechanism. The expansion mechanism reduces the pressure of the refrigerant. The evaporator is connected to the expansion mechanism and causes the refrigerant to evaporate. The two-stage compression element has a first compression element that sucks in, compresses, and discharges the refrigerant and a second compression element that sucks in, further compresses, and discharges the refrigerant that has been discharged from the first compression element. The radiator is connected to the discharge side of the second compression element. The first refrigerant pipe interconnects the radiator and the expansion mechanism. The second refrigerant pipe interconnects the evaporator and the suction side of the first compression element. The first heat exchanger causes heat exchange to be performed between the refrigerant flowing through the first refrigerant pipe and the refrigerant flowing through the second refrigerant pipe. The first heat exchange bypass pipe interconnects one end side and the other end side of portion of the first refrigerant pipe passing through the first heat exchanger. The heat exchanger switching mechanism can switch between a state where it allows the refrigerant to flow in the portion of the first refrigerant pipe passing through the first heat exchanger and a state where it allows the refrigerant to flow in the first heat exchange bypass pipe.

In this refrigerating apparatus, the coefficient of performance can be improved by lowering the specific enthalpy of the refrigerant proceeding toward the expansion mechanism by the heat exchange in the first heat exchanger. Moreover, moderate superheat can be applied to the refrigerant sucked into the first compression element by the heat exchange in the first heat exchanger, and it becomes possible to suppress the occurrence of liquid compression in the first compression element to maintain device reliability and also to raise the discharge temperature to maintain at a high level the obtained water temperature.

A refrigerating apparatus of a second aspect of the invention is the refrigerating apparatus of the first aspect of the invention, further comprising a temperature detector and a controller. The temperature detector detects at least either one of the temperature of the air around the evaporator and the temperature of the refrigerant discharged from at least either one of the first compression element and the second compression element. The controller controls the heat exchanger switching mechanism to thereby increase the quantity of the refrigerant flowing through the portion of the first refrigerant pipe passing through the first heat exchanger when a condition in which, when the value detected by the temperature detector is the temperature of the air, the air temperature is higher than a predetermined high-temperature air temperature or, when the value detected by the temperature detector is the temperature of the refrigerant, the refrigerant temperature is lower than a predetermined low-temperature refrigerant temperature has been met.

In this refrigerating apparatus, even when it looks like the situation will become one where the temperature of the air around the evaporator will become high or where the temperature of the refrigerant discharged from the compression element will become low, the quantity of the refrigerant flowing through the portion of the first refrigerant pipe passing through the first heat exchanger can be increased.

Thus, the specific enthalpy of the refrigerant proceeding toward the expansion mechanism can be lowered, and it becomes possible to improve the coefficient of performance.

Because a moderate degree of superheat can be given to the refrigerant sucked into the first compression element, it can be made difficult for liquid compression to occur in the first compression element.

Moreover, because the degree of superheat of the refrigerant sucked into the first compression element can be raised, it becomes possible to handle a case where the required temperature in the radiator is high.

A refrigerating apparatus of a third aspect of the invention is a refrigerating apparatus where a working refrigerant reaches a supercritical state in at least part of a refrigeration cycle, the refrigerating apparatus comprising a first expansion mechanism and a second expansion mechanism that reduce the pressure of the refrigerant, an evaporator, a two-stage compression element, a third refrigerant pipe, a radiator, first refrigerant pipe, a fourth refrigerant pipe, fifth refrigerant pipe, a second heat exchanger, a temperature detector, and a controller. The evaporator is connected to the first expansion mechanism and causes the refrigerant to evaporate. The two-stage compression element has a first compression element and a second compression element. The first compression element sucks in, compresses, and discharges the refrigerant. The second compression element sucks in, further compresses, and discharges the refrigerant that has been discharged from the first compression element. The third refrigerant pipe extends so as to allow the refrigerant that has been discharged from the first compression element to be sucked into the second compression element. The radiator is connected to the discharge side of the second compression element. The first refrigerant pipe interconnects the radiator and the first expansion mechanism. The fourth refrigerant pipe branches from the first refrigerant pipe and extends to the second expansion mechanism. The fifth refrigerant pipe extends from the second expansion mechanism to the third refrigerant pipe. The second heat exchanger causes heat exchange to be performed between the refrigerant flowing through the first refrigerant pipe and the refrigerant flowing through the fifth refrigerant pipe. The temperature detector detects at least either one of the temperature of the air around the evaporator and the temperature of the refrigerant discharged from at least either one of the first compression element and the second compression element. The controller controls the second expansion mechanism to thereby increase the quantity of the refrigerant passing therethrough when a condition in which, when the value detected by the temperature detector is the temperature of the air, the air temperature is lower than a predetermined low-temperature air temperature or, when the value detected by the temperature detector is the temperature of the refrigerant, the refrigerant temperature is higher than a predetermined high-temperature refrigerant temperature has been met.

In this refrigerating apparatus, it becomes possible to improve the coefficient of performance by lowering the specific enthalpy of the refrigerant proceeding toward the expansion mechanisms.

Further, it becomes possible to suppress an excessive rise in the temperature of the refrigerant discharged from the second compression element when the temperature of the refrigerant merging together from the fifth refrigerant pipe is lower than the temperature of the refrigerant flowing through the first refrigerant pipe. Moreover, the quantity of the refrigerant passing through the radiator can be increased.

Further, even when it looks like the temperature of the refrigerant discharged from the two-stage compression element will become high or when the temperature of the air around the evaporator becomes low, an excessive rise in the temperature of the refrigerant discharged from the second compression element can be suppressed by increasing the quantity of the refrigerant passing through the second expansion mechanism, and it becomes possible to improve the reliability of the two-stage compression element.

A refrigerating apparatus of a fourth aspect of the invention is the refrigerating apparatus of the third aspect of the invention, further comprising an external cooler that can cool the refrigerant passing through the third refrigerant pipe, an external temperature detector that detects the temperature of a fluid passing through the external cooler, and a third refrigerant temperature detector that detects the temperature of the refrigerant passing through the third refrigerant pipe. Additionally, the controller controls the second expansion mechanism to thereby increase the quantity of the refrigerant passing therethrough when the difference between the temperature detected by the external temperature detector and the temperature detected by the third refrigerant temperature detector has become less than a predetermined value.

In this refrigerating apparatus, even when the effect of cooling, with the external cooler, the refrigerant flowing through the first refrigerant pipe is not sufficiently obtained, it becomes possible to improve the coefficient of performance of the refrigeration cycle by lowering the temperature of the refrigerant passing through the third refrigerant by allowing the refrigerant passing through the fifth refrigerant pipe to merge together.

A refrigerating apparatus of a fifth aspect of the invention is a refrigerating apparatus where a working refrigerant reaches a supercritical state in at least part of a refrigeration cycle, the refrigerating apparatus comprising a first expansion mechanism and a second expansion mechanism that reduce the pressure of the refrigerant, an evaporator, a two-stage compression element, a radiator, first refrigerant pipe, second refrigerant pipe, a third refrigerant pipe, a first heat exchanger, a fourth refrigerant pipe, fifth refrigerant pipe, a second heat exchanger, a temperature detector, and a second expansion controller. The evaporator causes the refrigerant to evaporate. The two-stage compression element has a first compression element and a second compression element. The first compression element sucks in, compresses, and discharges the refrigerant. The second compression element sucks in, further compresses, and discharges the refrigerant that has been discharged from the first compression element. The radiator is connected to the discharge side of the second compression element. The first refrigerant pipe interconnects the radiator and the first expansion mechanism. The second refrigerant pipe interconnects the evaporator and the suction side of the first compression element. The third refrigerant pipe extends in order to allow the refrigerant that has been discharged from the first compression element to be sucked into the second compression element. The first heat exchanger causes heat exchange to be performed between the refrigerant flowing through the first refrigerant pipe and the refrigerant flowing through the second refrigerant pipe. The fourth refrigerant pipe branches from the first refrigerant pipe and extends to the second expansion mechanism. The fifth refrigerant pipe interconnects the second expansion mechanism and the third refrigerant pipe. The second heat exchanger causes heat exchange to be performed between the refrigerant flowing through the first refrigerant pipe and the refrigerant flowing through the fifth refrigerant pipe. The temperature detector detects at least either one of the temperature of the air around the evaporator and the temperature of the refrigerant discharged from at least either one of the first compression element and the second compression element. A second expansion controller controls the second expansion mechanism to thereby increase the quantity of the refrigerant passing therethrough when a condition in which, when the value detected by the temperature detector is the temperature of the air, the air temperature is lower than a predetermined low-temperature air temperature or, when the value detected by the temperature detector is the temperature of the refrigerant, the refrigerant temperature is higher than a predetermined high-temperature refrigerant temperature has been met.

In this refrigerating apparatus, it becomes possible to lower the specific enthalpy of the refrigerant proceeding toward the expansion mechanisms to improve the coefficient of performance and to apply moderate superheat to the refrigerant sucked into the first compression element to prevent liquid compression in the first compression element and/or cool the refrigerant flowing through the first refrigerant pipe. Moreover, even when it looks like the temperature of the refrigerant discharged from the compression element will become high or when the temperature of the air around the evaporator has become low, an excessive rise in the temperature of the refrigerant discharged from the second compression element can be suppressed by increasing the quantity of the refrigerant passing through the second expansion mechanism, and it becomes possible to improve the reliability of the two-stage compression element.

A refrigerating apparatus of a sixth aspect of the invention is the refrigerating apparatus of the fifth aspect of the invention, further comprising a first heat exchange bypass pipe and a heat exchanger switching mechanism. The first heat exchange bypass pipe interconnects one end side and the other end side of portion of the first refrigerant pipe passing through the first heat exchanger. The heat exchanger switching mechanism can switch between a state where it allows the refrigerant to flow in the portion of the first refrigerant pipe passing through the first heat exchanger and a state where it allows the refrigerant to flow in the first heat exchange bypass pipe.

In this refrigerating apparatus, it becomes possible to adjust usage in regard to the first heat exchanger by the switching of the heat exchanger switching mechanism and to adjust usage in regard to the second heat exchanger by the switching between the state that allows passage of the refrigerant in the second expansion mechanism and the state that does not allow passage of the refrigerant in the second expansion mechanism.

A refrigerating apparatus of a seventh aspect of the invention is the refrigerating apparatus of the sixth aspect of the invention, further comprising a temperature detector and a heat exchange switching controller. The temperature detector detects at least either one of the temperature of the air around the evaporator and the temperature of the refrigerant discharged from at least either one of the first compression element and the second compression element. The heat exchange switching controller controls the heat exchanger switching mechanism to thereby increase the quantity of the refrigerant flowing through the portion of the first refrigerant pipe passing through the first heat exchanger when a condition in which, when the value detected by the temperature detector is the temperature of the air, the air temperature is higher than a predetermined high-temperature air temperature or, when the value detected by the temperature detector is the temperature of the refrigerant, the refrigerant temperature is lower than a predetermined low-temperature refrigerant temperature has been met.

In this refrigerating apparatus, even when it looks like the temperature of the refrigerant discharged from the compression element will become low or when the temperature of the air around the evaporator has become high, the degree of superheat of the refrigerant sucked into the first compression element can be raised by increasing the quantity of the refrigerant flowing through the portion of the first refrigerant pipe passing through the first heat exchanger, and it becomes possible to handle a case where the required temperature in the radiator is high.

A refrigerating apparatus of an eighth aspect of the invention is the refrigerating apparatus of any of the fifth to seventh aspects of the invention, further comprising an external cooler that can cool the refrigerant passing through the third refrigerant pipe, an external temperature detector that detects the temperature of a fluid passing through the external cooler, and a third refrigerant temperature detector that detects the temperature of the refrigerant passing through the third refrigerant pipe. Additionally, the second expansion controller controls the second expansion mechanism to thereby increase the quantity of the refrigerant passing therethrough when the difference between the temperature detected by the external temperature detector and the temperature detected by the third refrigerant temperature detector has become less than a predetermined value.

In this refrigerating apparatus, even when the effect of cooling, with the external cooler, the refrigerant passing through the third refrigerant pipe is not sufficiently obtained, it becomes possible to improve the coefficient of performance of the refrigeration cycle by lowering the temperature of the refrigerant passing through the third refrigerant as a result of the refrigerant passing through the fifth refrigerant pipe merging together.

A refrigerating apparatus of a ninth aspect of the invention is the refrigerating apparatus of any of the first to eighth aspects of the invention, wherein the first compression element and the second compression element have a shared rotating shaft for performing compression work by driving each to rotate.

In this refrigerating apparatus, it becomes possible to suppress the occurrence of vibration and fluctuations in the torque load by driving the compression elements while allowing the centrifugal forces to cancel out each other.

A refrigerating apparatus of a tenth aspect of the invention is the refrigerating apparatus of any of the first to ninth aspects of the invention, wherein the working refrigerant is carbon dioxide.

In this refrigerating apparatus, the carbon dioxide in a supercritical state near its critical point can dramatically change the density of the refrigerant by just changing the pressure of the refrigerant a little. For this reason, the efficiency of the refrigerating apparatus can be improved by little compression work.

Advantageous Effects of the Invention

As stated in the above description, according to the present invention, the following effects are obtained.

In the first aspect of the invention, it becomes possible to suppress the occurrence of liquid compression in the first compression element to improve device reliability while improving the coefficient of performance and also to raise the discharge temperature to maintain at a high level the obtained water temperature.

In the second aspect of the invention, the specific enthalpy of the refrigerant proceeding toward the expansion mechanism can be lowered, and it becomes possible to improve the coefficient of performance.

In the third aspect of the invention, it becomes possible to improve the reliability of the two-stage compression element.

In the fourth aspect of the invention, even when the effect of cooling, with the external cooler, the refrigerant flowing through the first refrigerant pipe is not sufficiently obtained, it becomes possible to improve the coefficient of performance of the refrigeration cycle.

In the fifth aspect of the invention, liquid compression in the first compression element can be prevented and/or the refrigerant flowing through the first refrigerant pipe can be cooled while improving the coefficient of performance, and even when it looks like the temperature of the refrigerant discharged from the compression element will become high or when the temperature of the air around the evaporator has become low, it becomes possible to improve the reliability of the two-stage compression element.

In the sixth aspect of the invention, it becomes possible to adjust the usage of the first heat exchanger and the second heat exchanger.

In the seventh aspect of the invention, even when it looks like the temperature of the refrigerant discharged from the compression element will become low or when the temperature of the air around the evaporator has become high, it becomes possible to handle a case where the required temperature in the radiator is high.

In the eighth aspect of the invention, even when the effect of cooling, with the external cooler, the refrigerant passing through the third refrigerant pipe is not sufficiently obtained, it becomes possible to improve the coefficient of performance of the refrigeration cycle.

In the ninth aspect of the invention, it becomes possible to suppress the occurrence of vibration and fluctuations in the torque load by driving the compression elements while allowing the centrifugal forces to cancel out each other.

In the tenth aspect of the invention, the efficiency of the refrigerating apparatus can be improved by little compression work.

DESCRIPTION OF EMBODIMENTS

<1> First Embodiment

<1-1> Configuration of Air Conditioning Apparatus

Figure 1:
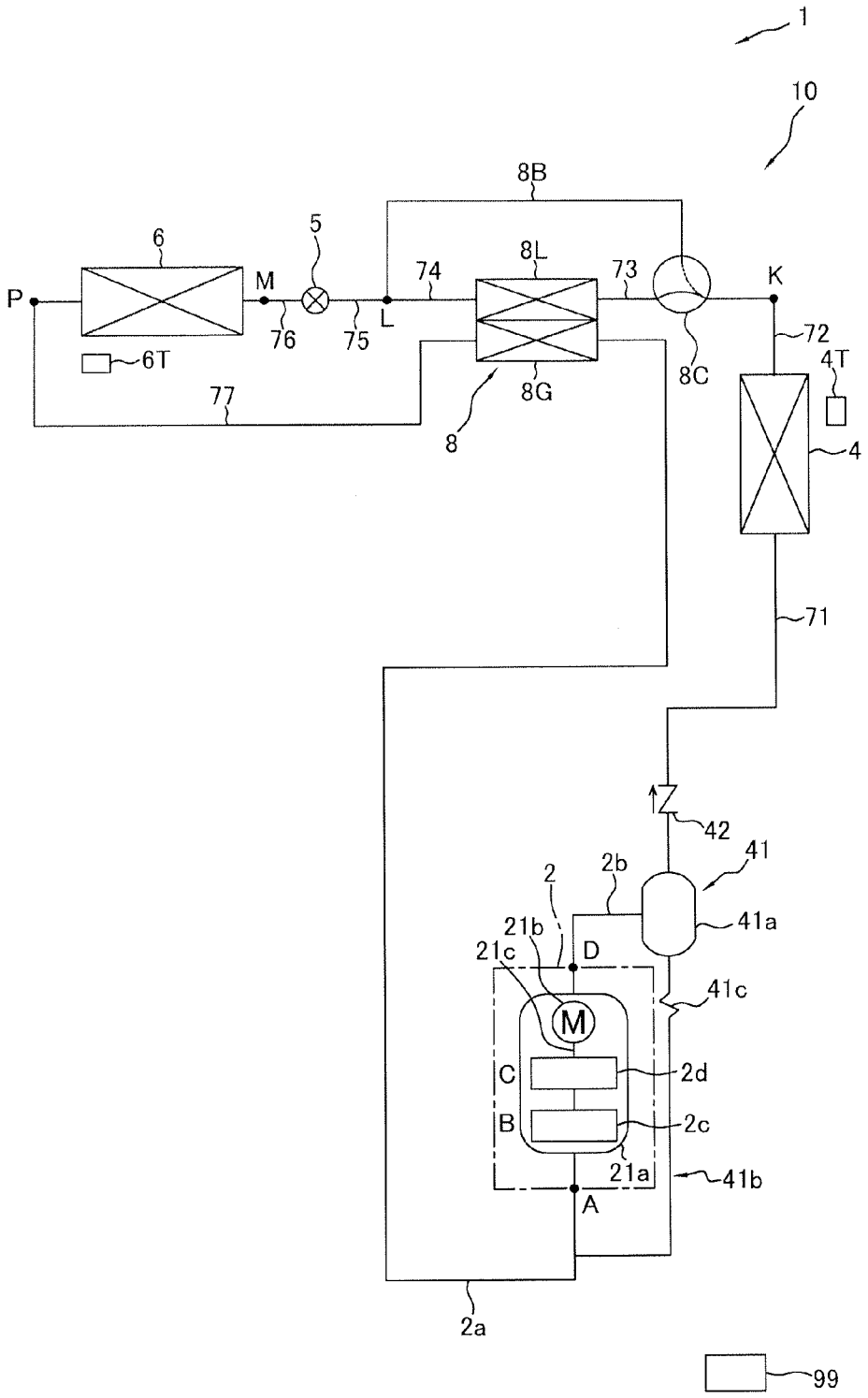
FIG. 1 is a general configuration diagram of an air conditioning apparatus serving as one embodiment of a refrigerating apparatus pertaining to a first embodiment of the present invention.

FIG. 1 is a general configuration diagram of an air conditioning apparatus 1 serving as one embodiment of a refrigerating apparatus pertaining to the present invention. The air conditioning apparatus 1 is an apparatus that performs a two-stage compression refrigeration cycle using a refrigerant (here, carbon dioxide) that works in a supercritical region.

A refrigerant circuit 10 of the air conditioning apparatus 1 mainly has a compression mechanism 2, a heat source-side heat exchanger 4, an expansion mechanism 5, a utilization-side heat exchanger 6, a liquid-gas heat exchanger 8, a liquid-gas three-way valve 8C, a liquid-gas bypass pipe 8B, connecting pipes 71, 72, 73, 74, 75, 76, and 77 that interconnect these, a utilization-side temperature sensor 6T, and a heat source-side temperature sensor 4T.

In the present embodiment, the compression mechanism 2 is configured from a compressor 21 that compresses the refrigerant in two stages with two compression elements. The compressor 21 has a closed structure where a compressor drive motor 21*b*, a drive shaft 21*c*, and compression elements 2*c* and 2*d* are housed inside a casing 21*a*. The compressor drive motor 21*b* is coupled to the drive shaft 21*c*. Additionally, this drive shaft 21*c* is coupled to the two compression elements 2*c* and 2*d*. That is, the compressor 21 has a so-called single-shaft two-stage compression structure where the two compression elements 2*c* and 2*d* are coupled to the single drive shaft 21*c* and where the two compression elements 2*c* and 2*d* are both driven to rotate by the compressor drive motor 21*b*. In the present embodiment, the compression elements 2*c* and 2*d* are rotary or scroll positive displacement compression elements. Additionally, the compressor 21 is configured to suck in the refrigerant from a suction pipe 2*a*, compress this sucked-in refrigerant with the compression element 2*c*, thereafter allow the refrigerant to be sucked into the compression element 2*d* to further compress the refrigerant, and thereafter discharge the refrigerant into a discharge pipe 2*b*. Further, the discharge pipe 2*b* is a refrigerant pipe for sending the refrigerant that has been discharged from the compression mechanism 2 to the heat source-side heat exchanger 4, and an oil separating mechanism 41 and a check mechanism 42 are disposed in the discharge pipe 2*b*. The oil separating mechanism 41 is a mechanism that separates refrigerating machine oil accompanying the refrigerant discharged from the compression mechanism 2 from that refrigerant and returns the refrigerating machine oil to the suction side of the compression mechanism 2. The oil separating mechanism 41 mainly has an oil separator 41*a*, which separates the refrigerating machine oil accompanying the refrigerant discharged from the compression mechanism 2 from that refrigerant, and an oil return pipe 41*b*, which is connected to the oil separator 41*a* and returns the refrigerating machine oil that has been separated from the refrigerant to the suction pipe 2*a* of the compression mechanism 2. A pressure reducing mechanism 41*c* that reduces the pressure of the refrigerating machine oil flowing through the oil return pipe 41*b* is disposed in the oil return pipe 41*b*. In the present embodiment, a capillary tube is used for the pressure reducing mechanism 41*c*. The check mechanism 42 is a mechanism for allowing flow of the refrigerant from the discharge side of the compression mechanism 2 to the heat source-side heat exchanger 4 and for blocking flow of the refrigerant from the heat source-side heat exchanger 4 to the discharge side of the compression mechanism 2. In the present embodiment, a check valve is used for the check mechanism 42.

In this manner, in the present embodiment, the compression mechanism 2 has the two compression elements 2*c* and 2*d* and is configured to sequentially compress the refrigerant that has been discharged from the former stage-side compression element of these compression elements 2*c* and 2*d* in the latter stage-side compression element.

The heat source-side heat exchanger 4 is a heat exchanger that functions as a radiator of the refrigerant using air as a heat source. The heat source-side heat exchanger 4 is configured such that one end thereof is connected to the discharge side of the compression mechanism 2 via the connecting pipe 71 and the check mechanism 42 and such that the other end thereof is connected to the liquid-gas three-way valve 8C via the connecting pipe 72.

The expansion mechanism 5 is configured such that one end thereof is connected to the liquid-gas three-way valve 8C via the connecting pipe 73, the liquid-gas heat exchanger 8 (a liquid-side liquid-gas heat exchanger 8L), and the connecting pipes 74 and 75 and such that the other end thereof is connected to the utilization-side heat exchanger 6 via the connecting pipe 76. This expansion mechanism 5 is a mechanism that reduces the pressure of the refrigerant. In the present embodiment, a motor-driven expansion valve is used for the expansion mechanism 5. Further, in the present embodiment, the expansion mechanism 5 reduces, to the vicinity of the saturation pressure of the refrigerant, the pressure of the high-pressure refrigerant that has been cooled in the heat source-side heat exchanger 4 before sending the refrigerant to the utilization-side heat exchanger 6.

The utilization-side heat exchanger 6 is a heat exchanger that functions as an evaporator of the refrigerant. The utilization-side heat exchanger 6 is configured such that one end thereof is connected to the expansion mechanism 5 via the connecting pipe 76 and such that the other end thereof is connected to the liquid-gas heat exchanger 8 (a gas-side liquid-gas heat exchanger 8G) via the connecting pipe 77. Although it is not shown here, water or air serving as a heating source that performs heat exchange with the refrigerant flowing through the utilization-side heat exchanger 6 is supplied to the utilization-side heat exchanger 6.

The utilization-side temperature sensor 6T detects the temperature of the water or air that is supplied as a heating source in order to cause heat exchange to be performed with the refrigerant flowing through the utilization-side heat exchanger 6.

The liquid-gas heat exchanger 8 has the liquid-side liquid-gas heat exchanger 8L, which allows the refrigerant flowing from the connecting pipe 73 toward the connecting pipe 74 to pass therethrough, and the gas-side liquid-gas heat exchanger 8G, which allows the refrigerant flowing from the connecting pipe 77 toward the suction pipe 2*a* to pass therethrough. Additionally, the liquid-gas heat exchanger 8 causes heat exchange to be performed between the refrigerant flowing through the liquid-side liquid-gas heat exchanger 8L and the refrigerant flowing through the gas-side liquid-gas heat exchanger 8G. Here, description is given using wording such as "liquid" side and "liquid"-gas heat exchanger 8, but the refrigerant passing through the liquid-side liquid-gas heat exchanger 8L is not limited to being in a liquid state and may also be refrigerant in a supercritical state, for example. Further, the refrigerant flowing through the gas-side liquid-gas heat exchanger 8G is also not limited to being refrigerant in a gas state. For example, wettish refrigerant may also flow through the gas-side liquid-gas heat exchanger 8G.

The liquid-gas bypass pipe 8B interconnects one switching port of the liquid-gas three-way valve 8C connected to the connecting pipe 73 on the upstream side of the liquid-side liquid-gas heat exchanger 8L and an end portion of the connecting pipe 74 extending on the downstream side of the liquid-side liquid-gas heat exchanger 8L.

The liquid-gas three-way valve 8C can switch between a liquid-gas utilization state of connection, where it connects the connecting pipe 72 extending from the heat source-side heat exchanger 4 to the connecting pipe 73 extending from the liquid-side liquid-gas heat exchanger 8L, and a liquid-gas non-utilization state of connection, where it connects the connecting pipe 72 extending from the heat source-side heat exchanger 4 to the liquid-gas bypass pipe 8B without connecting the connecting pipe 72 to the connecting pipe 73 extending from the liquid-side liquid-gas heat exchanger 8L.

The heat source-side temperature sensor 4T detects the temperature of water or air that is supplied as a heating target in the space where the heat source-side heat exchanger 4 is placed.

Moreover, the air conditioning apparatus 1 has a controller 99 that controls the operation of each of the parts configuring the air conditioning apparatus 1, such as the compression mechanism 2, the expansion mechanism 5, the liquid-gas three-way valve 8C, and the utilization-side temperature sensor 6T.

<1-2> Operation of Air Conditioning Apparatus

Next, the operation of the air conditioning apparatus 1 of the present embodiment will be described using FIG. 1, FIG. 2, and FIG. 3.

Figure 2:
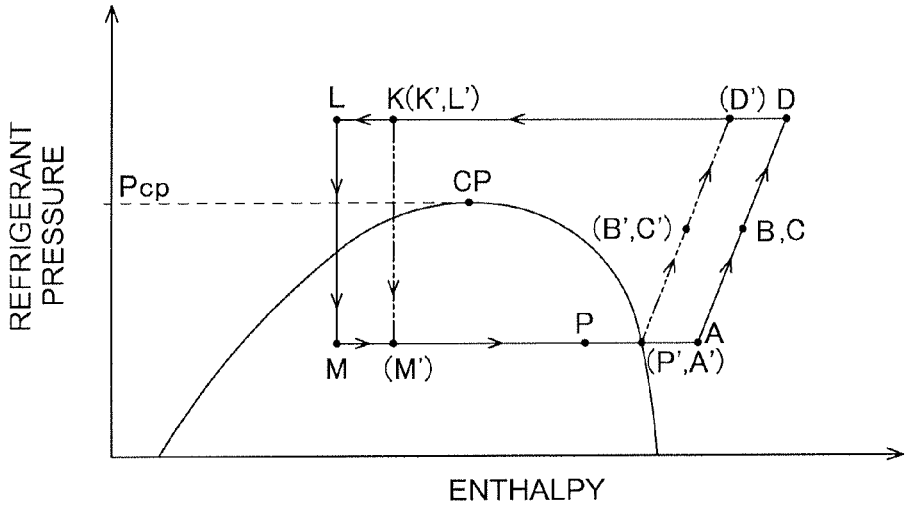
FIG. 2 is a pressure-enthalpy diagram in which the refrigeration cycle of the air conditioning apparatus pertaining to the first embodiment is shown.
Figure 3:
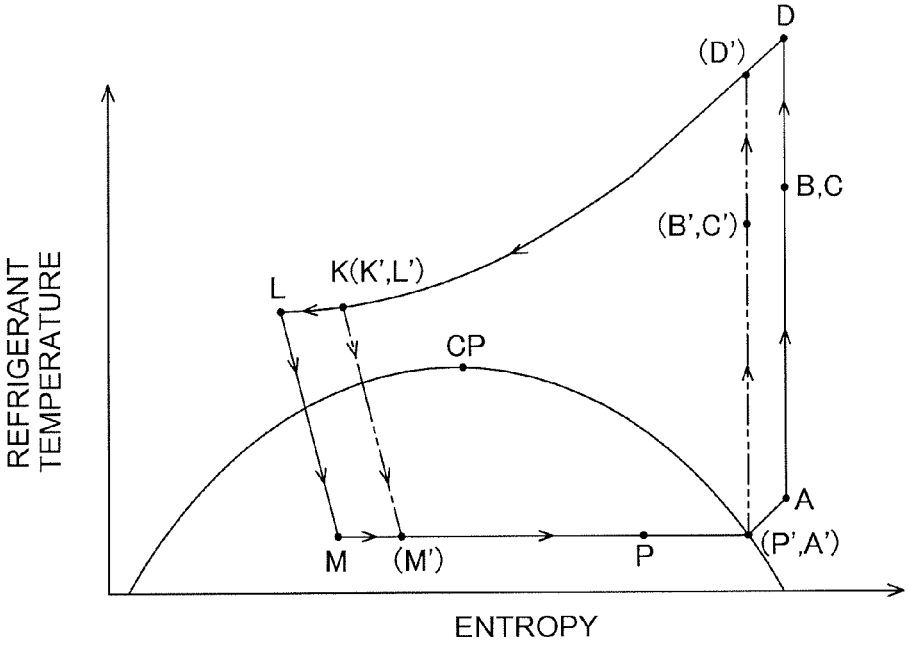
FIG. 3 is a temperature-entropy diagram in which the refrigeration cycle of the air conditioning apparatus pertaining to the first embodiment is shown.

Here, FIG. 2 is a pressure-enthalpy diagram in which the refrigeration cycle is shown, and FIG. 3 is a temperature-entropy diagram in which the refrigeration cycle is shown.

(Liquid-Gas Utilization State of Connection)

In the liquid-gas utilization state of connection, the state of connection of the liquid-gas three-way valve 8C is switched and controlled by the controller 99 such that, in the liquid-gas heat exchanger 8, heat exchange is performed between the refrigerant passing through the liquid-side liquid-gas heat exchanger 8L and the refrigerant passing through the gas-side liquid-gas heat exchanger 8G.

Here, the refrigerant that has been sucked in from the suction pipe 2*a* of the compression mechanism 2 (see point A in FIG. 2 and FIG. 3) is compressed by the low stage-side compression element 2*c* (see points B and C in FIG. 2 and FIG. 3) and is further compressed by the later stage-side compression element 2*d* until it reaches a pressure exceeding its critical pressure (see point D in FIG. 2 and FIG. 3), whereby high-temperature high-pressure refrigerant is sent from the compression mechanism 2 toward the heat source-side heat exchanger 4. Thereafter, the heat of the refrigerant is radiated in the heat source-side heat exchanger 4. Here, carbon dioxide is employed as the working refrigerant, and the refrigerant reaches a supercritical state and flows into the heat source-side heat exchanger 4, so in the radiation process, the pressure of the refrigerant remains constant and the temperature of the refrigerant itself continuously falls while the refrigerant radiates heat to the outside because of the change in its sensible heat (see K in FIG. 2 and FIG. 3). Then, the refrigerant that has exited the heat source-side heat exchanger 4 flows into the liquid-side liquid-gas heat exchanger 8L, and heat exchange is performed between that refrigerant and low-temperature low-pressure gas refrigerant flowing through the gas-side liquid-gas heat exchanger 8G, whereby the temperature of the refrigerant itself further continuously falls while the refrigerant further radiates heat (see point L in FIG. 2 and FIG. 3). This refrigerant that has exited the liquid-side liquid-gas heat exchanger 8L has its pressure reduced by the expansion mechanism 5 (see point M in FIG. 2 and FIG. 3) and flows into the utilization-side heat exchanger 6. In the utilization-side heat exchanger 6, the pressure of the refrigerant remains constant and the refrigerant evaporates while expending heat taken from the outside for the change in its latent heat because of heat exchange with the outside air or water, whereby the quality of wet vapor of the refrigerant increases (see point P in FIG. 2 and FIG. 3). The refrigerant that has exited from the utilization-side heat exchanger 6 flows into the gas-side liquid-gas heat exchanger 8G, where the pressure of the refrigerant remains constant, but this time the refrigerant further evaporates while undergoing a change in its latent heat because of heat taken by heat exchange between that refrigerant and the high-temperature high-pressure refrigerant passing through the liquid-side liquid-gas heat exchanger 8L, and the refrigerant exceeds the dry saturated vapor curve at this pressure and reaches a superheated state. Then, the refrigerant in this superheated state is sucked into the compression mechanism 2 through the suction pipe 2*a* (point A in FIG. 2 and FIG. 3). In the liquid-gas utilization state of connection, this circulation of the refrigerant is repeated.

(Liquid-Gas Non-Utilization State of Connection)

In the liquid-gas non-utilization state of connection, the controller 99 controls the state of connection of the liquid-gas three-way valve 8C to place the liquid-gas three-way valve 8C in a state where it interconnects the connecting pipe 72 and the liquid-gas bypass pipe 8B such that heat exchange in the liquid-gas heat exchanger 8 is not performed.

In the liquid-gas non-utilization state of connection also, point A', point B', point C', and point D' in FIG. 2 and FIG. 3 are the same as in the liquid-gas utilization state of connection, so description will be omitted.

Here, the refrigerant that has exited the heat source-side heat exchanger 4 does not flow into the liquid-side liquid-gas heat exchanger 8L but flows through the liquid-gas bypass pipe 8B and has its pressure reduced in the expansion mechanism 5 (see point K' and point L' in FIG. 2 and FIG. 3). Then, the refrigerant has its pressure reduced in the expansion mechanism 5 and flows into the utilization-side heat exchanger 6 (see point M' in FIG. 2 and FIG. 3). In the utilization-side heat exchanger 6, the pressure of the refrigerant remains constant and the refrigerant evaporates while expending heat taken from the outside for the change in its latent heat because of heat exchange with the outside air or water, whereby the refrigerant exceeds the dry saturated vapor curve at this pressure and reaches a superheated state. Then, the refrigerant in this superheated state is sucked into the compression mechanism 2 through the suction pipe 2*a* (see point P' and point A' in FIG. 2 and FIG. 3). In the liquid-gas non-utilization state of connection, this circulation of the refrigerant is repeated.

(Target Capacity Output Control)

In this refrigeration cycle, the controller 99 performs target capacity output control described below.

First, the controller 99 calculates, on the basis of the input value of a temperature setting inputted by a user via an unillustrated remote controller or the like and the air temperature of the space where the heat source-side heat exchanger 4 is placed which is detected by the heat source-side temperature sensor 4T, a required quantity of heat to be released in the space where the heat source-side heat exchanger 4 is disposed. The controller 99 also calculates, on the basis of this required quantity of heat to be released, a target discharge pressure in regard to the pressure of the refrigerant discharged from the compression mechanism 2.

Here, a case where the controller 99 uses the target discharge pressure for the target value in the target capacity output control is taken as an example and described, but in addition to this target discharge pressure, for example, the controller 99 may also be configured to set target values for the discharged refrigerant pressure and the discharged refrigerant temperature such that a value obtained by multiplying the discharged refrigerant pressure by the discharged refrigerant temperature falls within a predetermined range. Here, this is because when the load has changed, the density of the discharged refrigerant ends up becoming low when the degree of superheat of the sucked-in refrigerant is high, so even if the controller 99 is able to maintain the temperature of the refrigerant discharged from the high stage-side compression element 2*d*, there is the fear that the controller 99 will end up becoming unable to ensure the required quantity of heat to be released in the heat source-side heat exchanger 4.

Next, the controller 99 sets, on the basis of the temperature detected by the utilization-side temperature sensor 6T, a target evaporation temperature and a target evaporation pressure (a pressure equal to or lower than the critical pressure). Setting of this target evaporation pressure is performed each time the temperature detected by the utilization-side temperature sensor 6T changes.

Further, the controller 99 performs, on the basis of the value of this target evaporation temperature, degree of superheat control such that the degree of superheat of the refrigerant sucked in by the compression mechanism 2 becomes a target value x (a degree of superheat target value).

Then, in the compression process, the controller 99 controls the operational capacity of the compression mechanism 2 so as to raise the temperature of the refrigerant until the pressure of the refrigerant reaches the target discharge pressure while causing an isentropic change that maintains the value of entropy at the degree of superheat that has been set in this manner. Here, the controller 99 controls the operational capacity of the compression mechanism 2 by rotating speed control. The discharge pressure of the compression mechanism 2 is controlled such that it becomes a pressure exceeding the critical pressure.

Here, in the radiation process in the heat source-side heat exchanger 4, the refrigerant is in a supercritical state, so the temperature of the refrigerant continuously falls while the refrigerant undergoes an isobaric change with the pressure of the refrigerant being maintained at the target discharge pressure. Additionally, the refrigerant flowing through the heat source-side heat exchanger 4 is cooled to a value y that is equal to or higher than the temperature of the water or air supplied as a heating target and close to the temperature of this water or air supplied as a heating target. Here, the value of y is decided as a result of the supply quantity of the heating target supplied by an unillustrated heating target supply device (a pump in the case of water, a fan in the case of air, etc.) being controlled.

Moreover, here, the liquid-gas heat exchanger 8 is disposed, so in the liquid-gas utilization state of connection, the temperature of the refrigerant further continuously falls while the refrigerant undergoes an isobaric change with the pressure of the refrigerant being maintained at the target discharge pressure. Thus, the refrigerating capacity in the refrigeration cycle improves, so the coefficient of performance becomes better. Further, in the liquid-gas non-utilization state of connection described above, heat exchange in the liquid-gas heat exchanger 8 is not performed, so the degree of superheat of the refrigerant sucked into the compression mechanism 2 can be prevented from becoming too high. Thus, even if the refrigerant discharged from the compression mechanism 2 is given the target discharge pressure, the temperature of the discharged refrigerant can be prevented from rising too much, and the reliability of the compression mechanism 2 can be improved.

The refrigerant that has been cooled in the heat source-side heat exchanger 4 (and in the liquid-gas heat exchanger 8) in this manner has its pressure reduced by the expansion mechanism 5 until it becomes the target evaporation pressure (a pressure equal to or lower than the critical pressure) and flows into the utilization-side heat exchanger 6.

The refrigerant flowing through the utilization-side heat exchanger 6 absorbs heat from the water or air supplied as a heating source, whereby the quality of wet vapor of the refrigerant is improved while the refrigerant undergoes an isothermal-isobaric change while maintaining the target evaporation temperature and the target evaporation pressure. Additionally, the controller 99 controls the supply quantity of the heating source supplied by the unillustrated heating source supply device (a pump in the case of water, a fan in the case of air, etc.) such that the degree of superheat becomes the degree of superheat target value.

In performing control in this manner, the controller 99 calculates the value of x and the value of y and performs the above-described target capacity output control such that the coefficient of performance (COP) in the refrigeration cycle becomes the highest. Here, in calculating the value of x and the value of y with which the coefficient of performance will become the best, the controller 99 performs the calculation on the basis of the physicality of the carbon dioxide serving as the working refrigerant (a Mollier diagram or the like).

The controller 99 may also be configured to set a condition in which it can maintain the coefficient of performance at a good level to a certain extent and, if this condition is met, to obtain the value of x and the value of y such that the compression work becomes a smaller value. Further, the controller 99 may also be configured to use keeping the compression work equal to or less than a predetermined value as a precondition and to obtain the value of x and the value of y with which the coefficient of performance will become the best amid meeting this precondition.

(Liquid-Gas Heat Exchanger Switching Control)

Further, the controller 99 performs liquid-gas heat exchanger switching control to switch between the liquid-gas utilization state of connection and the liquid-gas non-utilization state of connection while performing the above-described target capacity output control.

In this liquid-gas heat exchanger switching control, the controller 99 switches the state of connection of the liquid-gas three-way valve 8C in response to the temperature detected by the utilization-side temperature sensor 6T.

In the above-described target capacity output control, the target evaporation temperature is set on the basis of the temperature detected by the utilization-side temperature sensor 6T, but when the temperature detected by the utilization-side temperature sensor 6T becomes low and the target evaporation temperature also becomes set lower, the temperature of the discharged refrigerant ends up rising under a control condition in which the target discharge pressure of the compression mechanism 2 does not change (under a condition in which it is necessary to ensure the required quantity of heat to be released in the heat source-side heat exchanger 4). When the temperature of the discharged refrigerant ends up rising too much in this manner, this ends up impairing the reliability of the compression mechanism 2. For that reason, here, the controller 99 performs control to switch the state of connection of the liquid-gas three-way valve 8C to the liquid-gas non-utilization state of connection. Thus, even if the temperature detected by the utilization-side temperature sensor 6T becomes low and the target evaporation temperature also becomes set lower, the extent of the rise in the degree of superheat of the refrigerant sucked into the compression mechanism 2 is controlled, and the required quantity of heat to be released can be maintained while suppressing a rise in the temperature of the discharged refrigerant.

On the other hand, in the above-described target capacity output control, the target evaporation temperature is set on the basis of the temperature detected by the utilization-side temperature sensor 6T, but when the temperature detected by the utilization-side temperature sensor 6T becomes high and the target evaporation temperature also becomes set higher, the temperature of the discharged refrigerant falls under a control condition in which the target discharge pressure of the compression mechanism 2 does not change (under a condition in which it is necessary to ensure the required quantity of heat to be released in the heat source-side heat exchanger 4). In this case, sometimes refrigerant in a state having the required quantity of heat to be released becomes unable to be supplied to the heat source-side heat exchanger 4. In this case, the controller 99 can switch the state of connection of the liquid-gas three-way valve 8C to the liquid-gas utilization state of connection to thereby raise the degree of superheat of the refrigerant sucked into the compression mechanism 2 and ensure the required quantity of heat to be released in the heat source-side heat exchanger 4. Further, even if the required quantity of heat to be released can be supplied in this manner, sometimes the coefficient of performance can be improved. In this case, the controller 99 can switch the state of connection of the liquid-gas three-way valve 8C to the liquid-gas utilization state of connection to thereby lower the specific enthalpy of the refrigerant sucked into the expansion mechanism 5 and improve the refrigerating capacity of the refrigeration cycle, so that the coefficient of performance can be improved while ensuring the required quantity of heat to be released. Because a moderate degree of superheat can be ensured for the refrigerant sucked into the compression mechanism 2, the fear that liquid compression will end up occurring in the compression mechanism 2 can be prevented.

<1-3> Modification 1

In the above-described embodiment, a case where the controller 99 switches the state of connection of the liquid-gas three-way valve 8C on the basis of the temperature detected by the utilization-side temperature sensor 6T (on the basis of the target evaporation temperature that is set) has been taken as an example and described.

Figure 4:
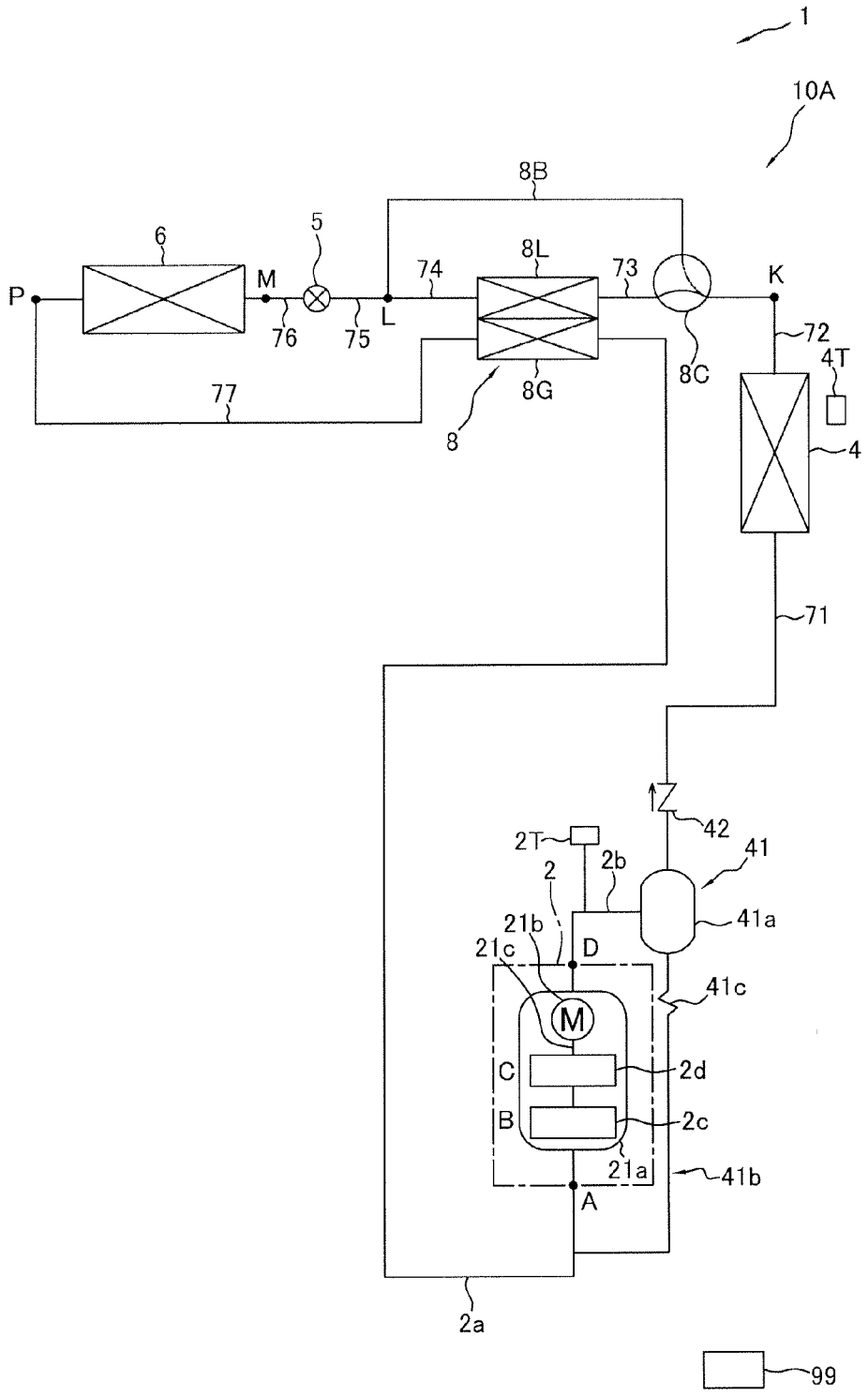
FIG. 4 is a general configuration diagram of an air conditioning apparatus pertaining to modification 1 of the first embodiment.

However, the present invention is not limited to this. For example, as shown in FIG. 4, a refrigerant circuit 10A that has, instead of the utilization-side temperature sensor 6T, a discharged refrigerant temperature sensor 2T that detects the temperature of the refrigerant discharged from the compression mechanism 2 may also be employed.

In this discharged refrigerant temperature sensor 2T, the case described above where the temperature detected by the utilization-side temperature sensor 6T becomes high corresponds to a case where the temperature detected by the discharged refrigerant temperature sensor 2T becomes low, and the case described above where the temperature detected by the utilization-side temperature sensor 6T becomes low corresponds to a case where the temperature detected by the discharged refrigerant temperature sensor 2T becomes high. That is, when the temperature detected by the discharged refrigerant temperature sensor 2T becomes too high, the reliability of the compression mechanism 2 ends up becoming unable to be maintained, so the controller 99 switches the state of connection of the liquid-gas three-way valve 8C to the liquid-gas non-utilization state of connection to thereby prevent the degree of superheat of the refrigerant sucked into the compression mechanism 2 from becoming large. Further, when the temperature detected by the discharged refrigerant temperature sensor 2T becomes low, the required quantity of heat to be released in the heat source-side heat exchanger 4 becomes unable to be supplied, so the controller 99 switches the state of connection of the liquid-gas three-way valve 8C to the liquid-gas utilization state of connection to thereby raise the degree of superheat of the refrigerant sucked into the compression mechanism 2 and ensure capacity. Further, in a situation where the temperature of the refrigerant sucked into the compression mechanism 2 is low and the temperature of the refrigerant discharged from the compression mechanism 2 does not rise too much even if the degree of superheat is raised, the controller 99 switches the state of connection of the liquid-gas three-way valve 8C to the liquid-gas utilization state of connection to thereby lower the specific enthalpy of the refrigerant sent to the expansion mechanism 5 and improve the refrigerating capacity of the refrigeration cycle, and thereby raise the coefficient of performance.

<1-4> Modification 2

In the above-described embodiment, a case where the heat source-side heat exchanger 4 functions as a radiator has been taken as an example and described.

Figure 5:
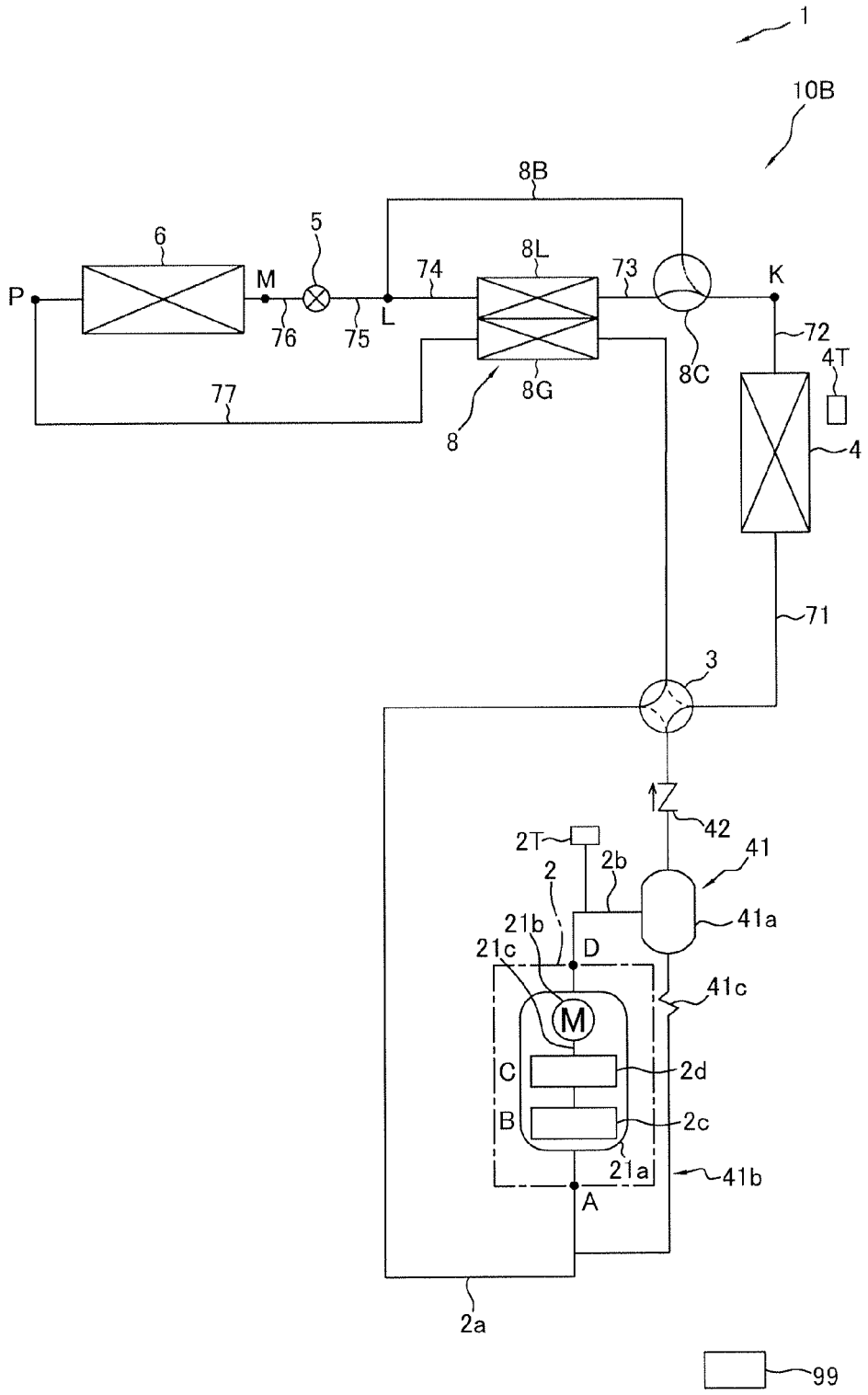
FIG. 5 is a general configuration diagram of an air conditioning apparatus pertaining to modification 2 of the first embodiment.

However, the present invention is not limited to this. For example, as shown in FIG. 5, the present invention may also employ a refrigerant circuit 10B that is further equipped with a switching mechanism 3 such that the heat source-side heat exchanger 4 can also function as an evaporator.

<1-5> Modification 3

In the above-described embodiment and modifications 1 and 2, a case where the controller 99 switches the state of connection of the liquid-gas three-way valve 8C between the liquid-gas utilization state of connection and the liquid-gas non-utilization state of connection has been taken as an example and described.

However, the present invention is not limited to this. For example, the controller 99 may also be configured to adjust the switched state of the liquid-gas three-way valve 8C to thereby allow the refrigerant to flow in both the liquid-gas bypass pipe 8B and the liquid-gas heat exchanger 8L and control the flow rate ratio of the refrigerant in both flow paths.

<1-6> Modification 4

In the above-described embodiment and modifications 1 to 3, refrigerant circuits in which the liquid-gas three-way valve 8C is disposed have been taken as examples and described.

However, the present invention is not limited to this. For example, the present invention may also employ a refrigerant circuit where, instead of the liquid-gas three-way valve 8C, an opening-and-closing valve is disposed in the connecting pipe 73 and an opening-and-closing valve is also disposed in the liquid-gas bypass pipe 8B.

<1-7> Modification 5

In the above-described embodiment and modifications 1 to 4, refrigerant circuits in which only one of the compression mechanism 2 with which the refrigerant is compressed in two stages is disposed have been taken as examples and described.

However, the present invention is not limited to this. For example, the present invention may also employ a refrigerant circuit where a plurality of the compression mechanisms 2 that perform compression in two stages are disposed in parallel to each other.

Further, a plurality of the utilization-side heat exchangers 6 may also be placed in parallel to each other in the refrigerant circuit. In this case, the present invention may employ a refrigerant circuit where, in order to be able to control the quantity of the refrigerant supplied to each of the utilization-side heat exchangers 6, an expansion mechanism is placed just before each of the utilization-side heat exchangers so that the expansion mechanisms are also placed in parallel to each other.

<2> Second Embodiment

<2-1> Configuration of Air Conditioning Apparatus

In an air conditioning apparatus 201 of a second embodiment, there is employed a refrigerant circuit 210 in which the liquid-gas heat exchanger 8 and the liquid-gas three-way valve 8C of the air conditioning apparatus 1 of the first embodiment are not disposed but which instead has an economizer circuit 9 and an economizer heat exchanger 20 and in which an intermediate refrigerant pipe 22 that guides the refrigerant discharged from the low stage-side compression element 2*c* of the compression mechanism 2 to the high stage-side compression element 2*d* is disposed. The air conditioning apparatus 201 will be described below centering on the points of difference with the above-described embodiment.

The economizer circuit 9 has a branch upstream pipe 9*a* that branches from a branch point X between the connecting pipe 72 and a connecting pipe 73*c*, an economizer expansion mechanism 9*e* that reduces the pressure of the refrigerant, a branch midstream pipe 9*b* that guides the refrigerant whose pressure has been reduced by the economizer expansion mechanism 9*e* to the economizer heat exchanger 20, and a branch downstream pipe 9*c* that guides the refrigerant that has flowed out from the economizer heat exchanger 20 to a merge point Y in the intermediate refrigerant pipe 22.

The connecting pipe 73*c* guides the refrigerant through the economizer heat exchanger 20 to a connecting pipe 75*c*. This connecting pipe 75*c* is connected to the expansion mechanism 5.

The remaining configuration is the same as that of the air conditioning apparatus 1 of the first embodiment described above.

<2-2> Operation of Air Conditioning Apparatus

Next, the operation of the air conditioning apparatus 201 of the present embodiment will be described using FIG. 6, FIG. 7, and FIG. 8.

Figure 7:
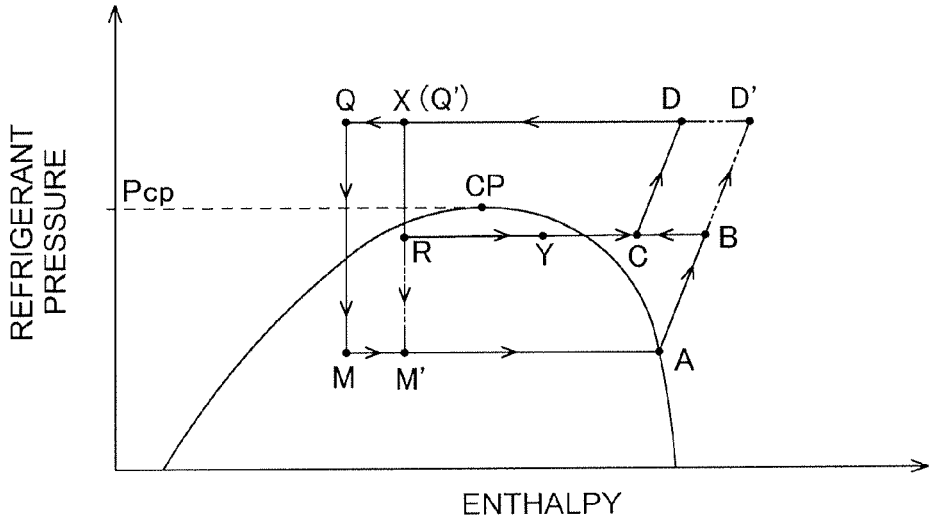
FIG. 7 is a pressure-enthalpy diagram in which the refrigeration cycle of the air conditioning apparatus pertaining to the second embodiment is shown.
Figure 8:
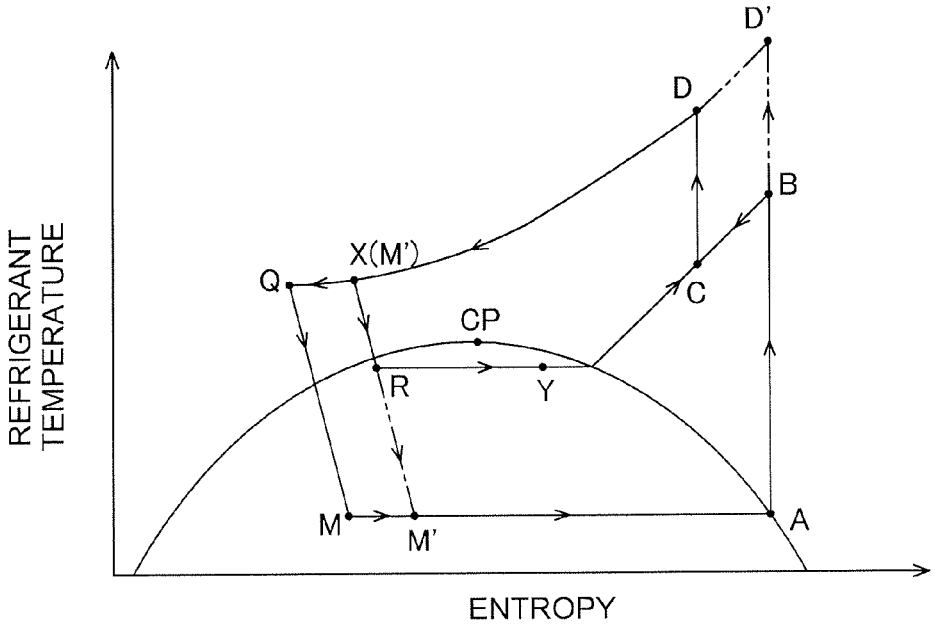
FIG. 8 is a temperature-entropy diagram in which the refrigeration cycle of the air conditioning apparatus pertaining to the second embodiment is shown.

Here, FIG. 7 is a pressure-enthalpy diagram in which the refrigeration cycle is shown, and FIG. 8 is a temperature-entropy diagram in which the refrigeration cycle is shown.

(Economizer Utilization State)

In an economizer utilization state, the controller 99 adjusts the opening degree of the economizer expansion mechanism 9*e* to thereby allow the refrigerant to flow in the economizer circuit 9.

In the economizer circuit 9, the refrigerant that has branched from the branch point X and flowed into the branch upstream pipe 9*a* has its pressure reduced in the economizer expansion mechanism 9*e* (see point R in FIG. 6, FIG. 7, and FIG. 8) and flows into the economizer heat exchanger 20 via the branch midstream pipe 9*b*.

Figure 6:
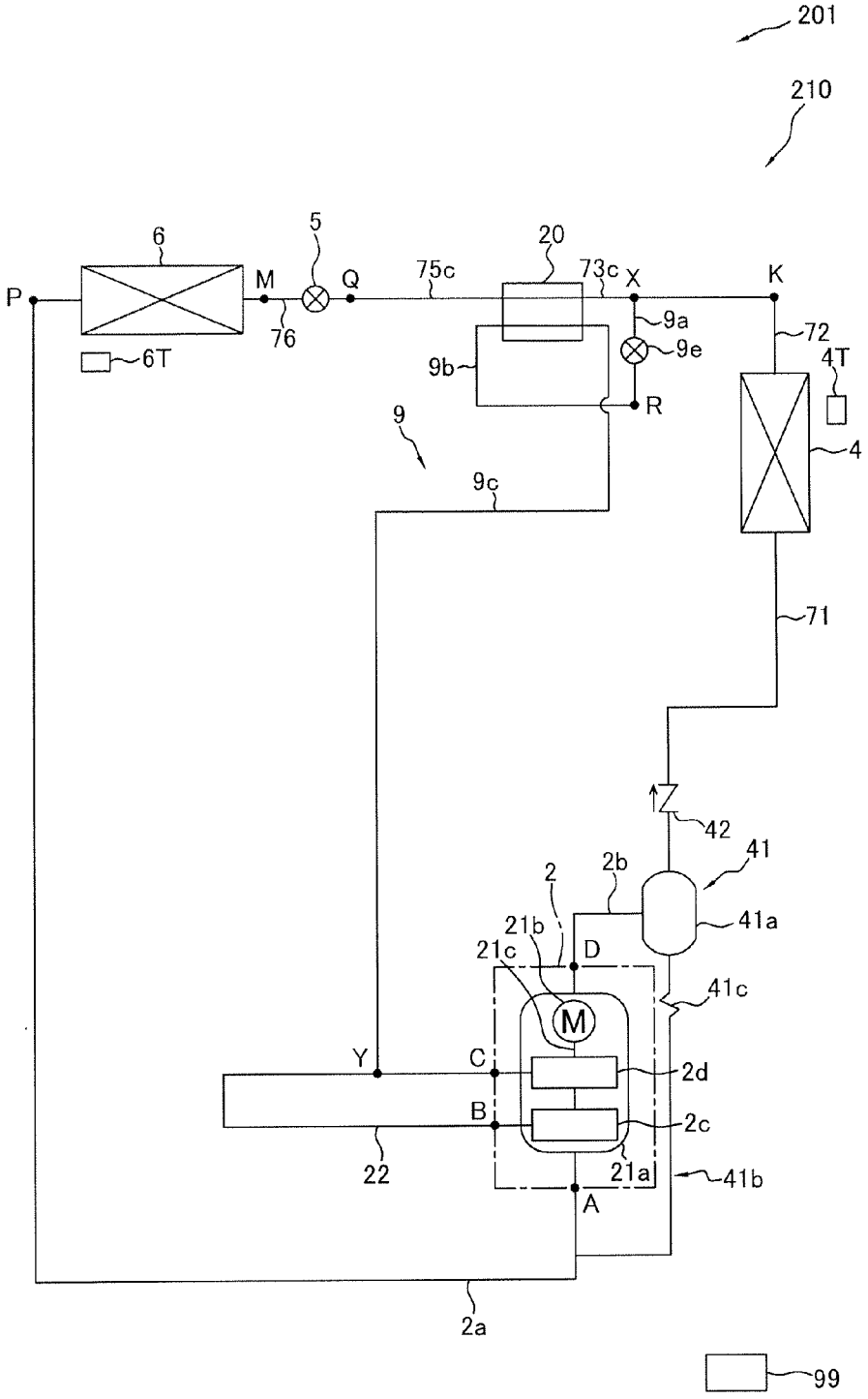
FIG. 6 is a general configuration diagram of an air conditioning apparatus serving as one embodiment of a refrigerating apparatus pertaining to a second embodiment of the present invention.

Then, in the economizer heat exchanger 20, heat exchange is performed between the refrigerant flowing through the connecting pipe 73*c* and the connecting pipe 75*c* (see point X→point Q in FIG. 6, FIG. 7, and FIG. 8) and the refrigerant flowing into the economizer heat exchanger 20 via the branch midstream pipe 9*b* (see point R→point Y in FIG. 6, FIG. 7, and FIG. 8).

At this time, the refrigerant flowing through the connecting pipe 73*c* and the connecting pipe 75*c* is cooled by the refrigerant flowing through the branch midstream pipe 9*b* whose pressure is reduced and whose temperature is falling in the economizer heat exchanger 20, and the specific enthalpy of the refrigerant flowing through the connecting pipe 73*c* and the connecting pipe 75*c* drops (see point X→point Q in FIG. 6, FIG. 7, and FIG. 8). In this manner, the degree of supercooling of the refrigerant sent to the expansion mechanism 5 increases, whereby the refrigerating capacity of the refrigeration cycle rises and the coefficient of performance improves. Then, this refrigerant whose specific enthalpy has dropped has its pressure reduced as a result of passing through the expansion mechanism 5 and flows into the utilization-side heat exchanger 6 (see point Q→point M in FIG. 6, FIG. 7, and FIG. 8). Then, the refrigerant evaporates in the utilization-side heat exchanger 6 and is sucked into the compression mechanism 2 (see point M→point A in FIG. 6, FIG. 7, and FIG. 8). The refrigerant that has been sucked into the compression mechanism 2 is compressed by the low stage-side compression element 2*c*, and the refrigerant whose pressure has risen to an intermediate pressure while being accompanied by a temperature rise flows through the intermediate refrigerant pipe 22.

Further, the refrigerant flowing into the economizer heat exchanger 20 via the branch midstream pipe 9*b* is heated by the refrigerant flowing through the connecting pipe 73*c* and the connecting pipe 75*c*, whereby the quality of wet vapor of the refrigerant improves (see point R→point Y in FIG. 6, FIG. 7, and FIG. 8).

In this manner, the refrigerant that has passed through the economizer circuit 9 (see point Y in FIG. 6, FIG. 7, and FIG. 8) merges with the refrigerant flowing through the intermediate refrigerant pipe 22 (point B in FIG. 6, FIG. 7, and FIG. 8) at the merge point Y in the intermediate refrigerant pipe 22 described above, the temperature of the refrigerant falls while the refrigerant maintains the intermediate pressure, the degree of superheat of the refrigerant discharged from the low stage-side compression element 2*c* is reduced, and the refrigerant is sucked into the high stage-side compression element 2*d* (see point Y, point B, and point C in FIG. 6, FIG. 7, and FIG. 8). Thus, because the temperature of the refrigerant sucked into the high stage-side compression element 2*d* falls, the temperature of the refrigerant discharged from the high stage-side compression element 2*d* can be prevented from rising too much. Further, the density of the refrigerant rises as a result of the temperature of the refrigerant sucked into the high stage-side compression element 2*d* falling, and the quantity of the refrigerant circulating through the heat source-side heat exchanger 4 increases because of the refrigerant injected via the economizer circuit 9, so the capacity that can be supplied to the heat source-side heat exchanger 4 can be significantly increased.

In the economizer utilization state, this circulation of the refrigerant is repeated.

(Economizer Non-Utilization State)

In an economizer non-utilization state, the economizer expansion mechanism 9*e* in the economizer circuit 9 is placed in a completely closed state. Thus, there is no longer a flow of the refrigerant in the branch midstream pipe 9*b* ceases, and the economizer heat exchanger 20 no longer functions (see point Q', point M', and point D' in FIG. 6, FIG. 7, and FIG. 8).

Thus, the effect of cooling the refrigerant flowing through the intermediate refrigerant pipe 22 ceases, so the temperature of the refrigerant discharged from the high stage-side compression element 2*d* rises.

(Target Capacity Output Control)

In this refrigeration cycle, the controller 99 performs target capacity output control described below.

First, the controller 99 calculates, on the basis of the input value of a temperature setting inputted by a user via an unillustrated controller or the like and the air temperature of the space where the heat source-side heat exchanger 4 is placed, and which is detected by the heat source-side temperature sensor 4T, a required quantity of heat to be radiated in the space where the heat source-side heat exchanger 4 is disposed. The controller 99 also calculates, on the basis of this required quantity of heat to be radiated, a target discharge pressure in regard to the pressure of the refrigerant discharged from the compression mechanism 2.

Here, a case where the controller 99 uses the target discharge pressure for the target value in the target capacity output control is taken as an example and described, but in addition to this target discharge pressure, for example, the controller 99 may also be configured to set target values for the discharged refrigerant pressure and the discharged refrigerant temperature such that a value obtained by multiplying the discharged refrigerant temperature by the discharged refrigerant pressure falls within a predetermined range. Here, this is because when the load has changed, the density of the discharged refrigerant ends up becoming low when the degree of superheat of the sucked-in refrigerant is high, so even if the controller 99 is able to maintain the temperature of the refrigerant discharged from the high stage-side compression element 2*d*, there is the fear that the controller 99 will end up becoming unable to ensure the required quantity of heat to be radiated in the heat source-side heat exchanger 4.

Next, the controller 99 sets, on the basis of the temperature detected by the utilization-side temperature sensor 6T, a target evaporation temperature and a target evaporation pressure (a pressure equal to or lower than the critical pressure). Setting of this target evaporation pressure is performed each time the temperature detected by the utilization-side temperature sensor 6T changes.

Further, the controller 99 performs, on the basis of the value of this target evaporation temperature, degree of superheat control such that the degree of superheat of the refrigerant sucked in by the compression mechanism 2 becomes a target value x (a degree of superheat target value).

Then, in the compression process, the controller 99 controls the operational capacity of the compression mechanism 2 so as to raise the temperature of the refrigerant until the pressure of the refrigerant reaches the target discharge pressure while causing an isentropic change that maintains the value of entropy at the degree of superheat that has been set in this manner. Here, the controller 99 controls the operational capacity of the compression mechanism 2 by rotating speed control. The discharge pressure of the compression mechanism 2 is controlled such that it becomes a pressure exceeding the critical pressure.

Here, in the radiation process in the heat source-side heat exchanger 4, the refrigerant is in a supercritical state, so the temperature of the refrigerant continuously falls while refrigerant undergoes an isobaric change with the pressure of the refrigerant being maintained at the target discharge pressure. Additionally, the refrigerant flowing through the heat source-side heat exchanger 4 is cooled to a value y that is equal to or higher than the temperature of the water or air supplied as a heating target and close to the temperature of this water or air supplied as a heating target. Here, the value of y is decided as a result of the supply quantity of the heating target supplied by an unillustrated heating target supply device (a pump in the case of water, a fan in the case of air, etc.) being controlled.

Moreover, here, the economizer circuit 9 is disposed, so in the economizer utilization state described above, the temperature of the refrigerant that has flowed from the connecting pipe 73*c* into the economizer heat exchanger 20 further continuously falls while the refrigerant undergoes an isobaric change with the pressure of the refrigerant being maintained at the target discharge pressure, and the refrigerant becomes sent to the connecting pipe 75*c*. Thus, the refrigerating capacity in the refrigeration cycle improves, so the coefficient of performance becomes better. Further, the temperature of the refrigerant that flows through the intermediate refrigerant pipe 22 and is sucked into the high stage-side compression element 2*d* is lowered by the injection of the refrigerant that has passed through the economizer circuit 9, whereby an abnormal rise in the temperature of the refrigerant discharged from the high stage-side compression element 2*d* can be prevented. Further, in the economizer non-utilization state described above, heat exchange in the economizer heat exchanger 20 is not performed, so the temperature of the refrigerant sucked into the high stage-side compression element 2*d* does not fall, and the required quantity of heat to be radiated in the heat source-side heat exchanger 4 can be ensured.

The refrigerant that has been cooled in the heat source-side heat exchanger 4 (and in the economizer heat exchanger 20) in this manner has its pressure reduced by the expansion mechanism 5 until it becomes the target evaporation pressure (a pressure equal to or lower than the critical pressure) and flows into the utilization-side heat exchanger 6.

The refrigerant flowing through the utilization-side heat exchanger 6 absorbs heat from the water or air supplied as a heating source, whereby the quality of wet vapor of the refrigerant is improved while the refrigerant undergoes an isothermal-isobaric change while maintaining the target evaporation temperature and the target evaporation pressure. Additionally, the controller 99 controls the supply quantity of the heating source supplied by the unillustrated heating source supply device (a pump in the case of water, a fan in the case of air, etc.) such that the degree of superheat becomes the degree of superheat target value.

In performing control in this manner, the controller 99 calculates the value of x and the value of y and performs the above-described target capacity output control such that the coefficient of performance (COP) in the refrigeration cycle becomes the highest. Here, in calculating the value of x and the value of y with which the coefficient of performance will become the best, the controller 99 performs the calculation on the basis of the physicality of the carbon dioxide serving as the working refrigerant (a Mollier diagram or the like).

The controller 99 may also be configured to set a condition in which it can maintain the coefficient of performance at a good level to a certain extent and, if this condition is met, to obtain the value of x and the value of y such that the compression work becomes a smaller value. Further, the controller 99 may also be configured to use keeping the compression work equal to or less than a predetermined value as a precondition and to obtain the value of x and the value of y with which the coefficient of performance will become the best amid meeting this precondition.

(Economizer Switching Control)

Further, the controller 99 performs economizer switching control to switch between the above-described economizer utilization state and the economizer non-utilization state while performing the above-described target capacity output control.

In this economizer switching control, the controller 99 controls the opening degree of the economizer expansion mechanism 9*e* in response to the temperature detected by the utilization-side temperature sensor 6T.

In the above-described target capacity output control, the target evaporation temperature is set on the basis of the temperature detected by the utilization-side temperature sensor 6T, but when the temperature detected by the utilization-side temperature sensor 6T becomes low and the target evaporation temperature also becomes set lower, the temperature of the discharged refrigerant ends up rising under a control condition in which the target discharge pressure of the compression mechanism 2 does not change (under a condition in which it is necessary to ensure the required quantity of heat to be radiated in the heat source-side heat exchanger 4). When the temperature of the discharged refrigerant ends up rising too much in this manner, this ends up impairing the reliability of the compression mechanism 2. For that reason, here, the controller 99 performs control to switch to the economizer utilization state that causes the economizer heat exchanger 20 to function by opening the economizer expansion mechanism 9*e* to allow the refrigerant to flow in the economizer circuit 9. Thus, even if the temperature detected by the utilization-side temperature sensor 6T becomes low and the target evaporation temperature also becomes set lower, the extent of the rise in the temperature of the refrigerant sucked in by the high stage-side compression element 2*d* of the compression mechanism 2 is controlled, and the required quantity of heat to be radiated can be maintained while suppressing a rise in the temperature of the discharged refrigerant.

On the other hand, in the above-described target capacity output control, the target evaporation temperature is set on the basis of the temperature detected by the utilization-side temperature sensor 6T, but when the temperature detected by the utilization-side temperature sensor 6T becomes high and the target evaporation temperature also becomes set higher, the temperature of the discharged refrigerant falls under a control condition in which the target discharge pressure of the compression mechanism 2 does not change (under a condition in which it is necessary to ensure the required quantity of heat to be radiated in the heat source-side heat exchanger 4). In this case, sometimes refrigerant in a state having the required quantity of heat to be radiated becomes unable to be supplied to the heat source-side heat exchanger 4. In this case, the controller 99 can switch to the economizer non-utilization state that places the economizer expansion mechanism 9*e* in a completely closed state, to thereby ensure that the degree of superheat of the refrigerant sucked into the high stage-side compression element 2*d* of the compression mechanism 2 does not fall and to ensure the required quantity of heat to be radiated required in the heat source-side heat exchanger 4. Further, even if the required quantity of heat to be radiated can be supplied in this manner, sometimes the coefficient of performance can be improved. In this case, the controller 99 can open the economizer expansion mechanism 9*e* to switch to the economizer utilization state to thereby lower the specific enthalpy of the refrigerant sucked into the expansion mechanism 5 and improve the refrigerating capacity of the refrigeration cycle, so that the coefficient of performance can be improved while ensuring the required quantity of heat to be radiated.

<2-3> Modification 1

In the above-described embodiment, a case where the controller 99 switches the opening degree of the economizer expansion mechanism 9*e* on the basis of the temperature detected by the utilization-side temperature sensor 6T (on the basis of the target evaporation temperature that is set) has been taken as an example and described.

Figure 9:
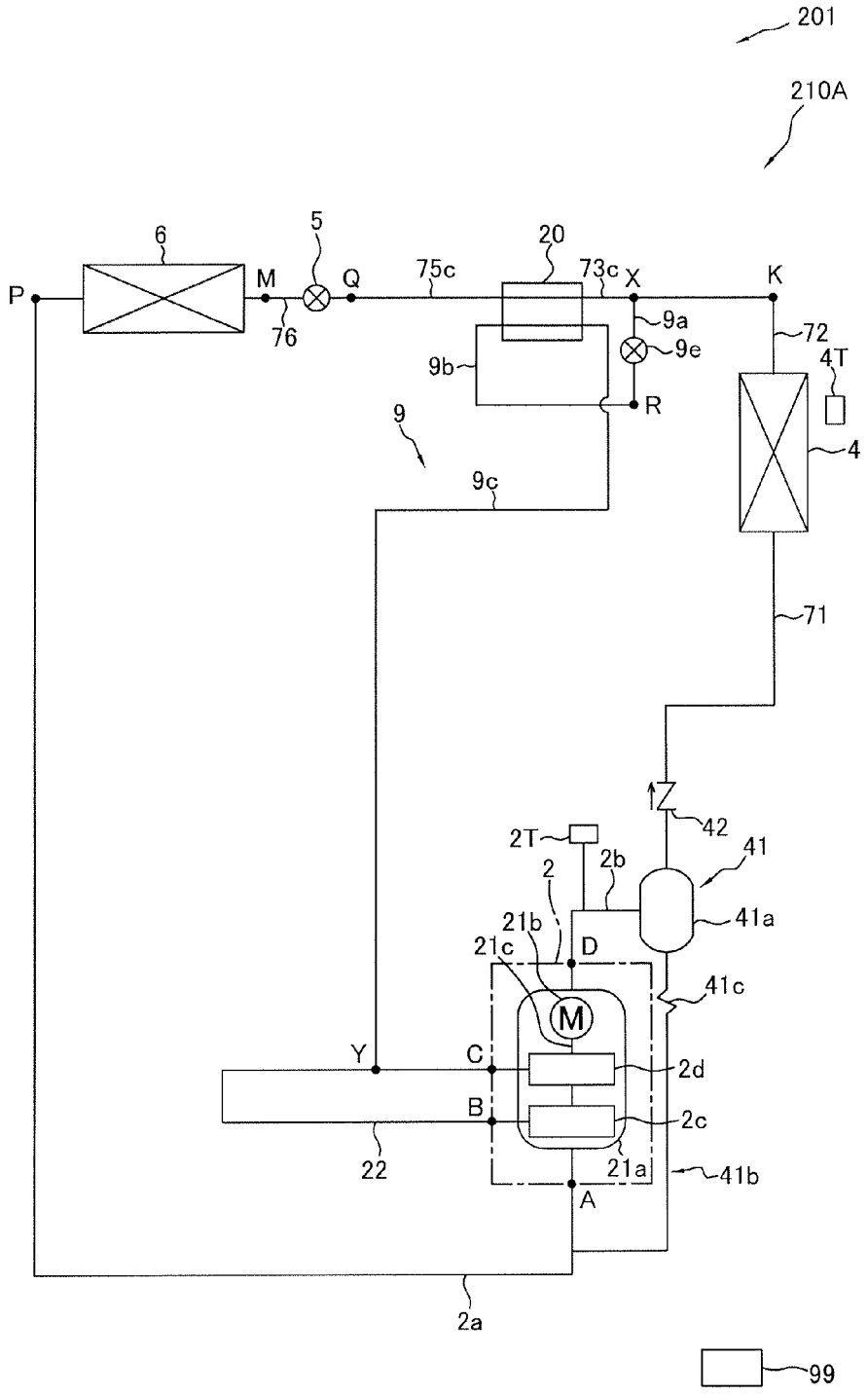
FIG. 9 is a general configuration diagram of an air conditioning apparatus pertaining to modification 1 of the second embodiment.

However, the present invention is not limited to this. For example, as shown in FIG. 9, a refrigerant circuit 210A that has, instead of the utilization-side temperature sensor 6T, a discharged refrigerant temperature sensor 2T that detects the temperature of the refrigerant discharged from the compression mechanism 2 may also be employed.

In this discharged refrigerant temperature sensor 2T, the case described above where the temperature detected by the utilization-side temperature sensor 6T becomes high corresponds to a case where the temperature detected by the discharged refrigerant temperature sensor 2T becomes low, and the case described above where the temperature detected by the utilization-side temperature sensor 6T becomes low corresponds to a case where the temperature detected by the discharged refrigerant temperature sensor 2T becomes high. That is, when the temperature detected by the discharged refrigerant temperature sensor 2T becomes too high, the reliability of the compression mechanism 2 ends up becoming unable to be maintained, so the controller 99 raises the opening degree of the economizer expansion mechanism 9*e* to switch to the economizer utilization state to thereby lower the degree of superheat of the refrigerant sucked into the high stage-side compression element 2*d* of the compression mechanism 2 and prevent the temperature of the refrigerant discharged from the high stage-side compression element 2*d* from becoming too high. Further, when the temperature detected by the discharged refrigerant temperature sensor 2T becomes low, the required quantity of heat to be radiated in the heat source-side heat exchanger 4 becomes unable to be supplied, so the controller 99 places the economizer expansion mechanism 9*e* in a completely closed state to switch the economizer expansion mechanism 9*e* to the economizer non-utilization state to thereby ensure capacity without lowering the degree of superheat of the refrigerant sucked into the compression mechanism 2. Further, in a situation where the temperature of the refrigerant sucked into the compression mechanism 2 is low and the temperature of the refrigerant discharged from the compression mechanism 2 does not rise too much even if the degree of superheat is raised, the controller 99 raises the opening degree of the economizer expansion mechanism 9*e* to switch the economizer expansion mechanism 9*e* to the economizer utilization state to thereby lower the specific enthalpy of the refrigerant sent to the expansion mechanism 5 and improve the refrigerant capacity of the refrigeration cycle, and thereby raise the coefficient of performance.

<2-4> Modification 2

In the above-described embodiment, a case where the heat source-side heat exchanger 4 functions as a radiator has been taken as an example and described.

Figure 10:
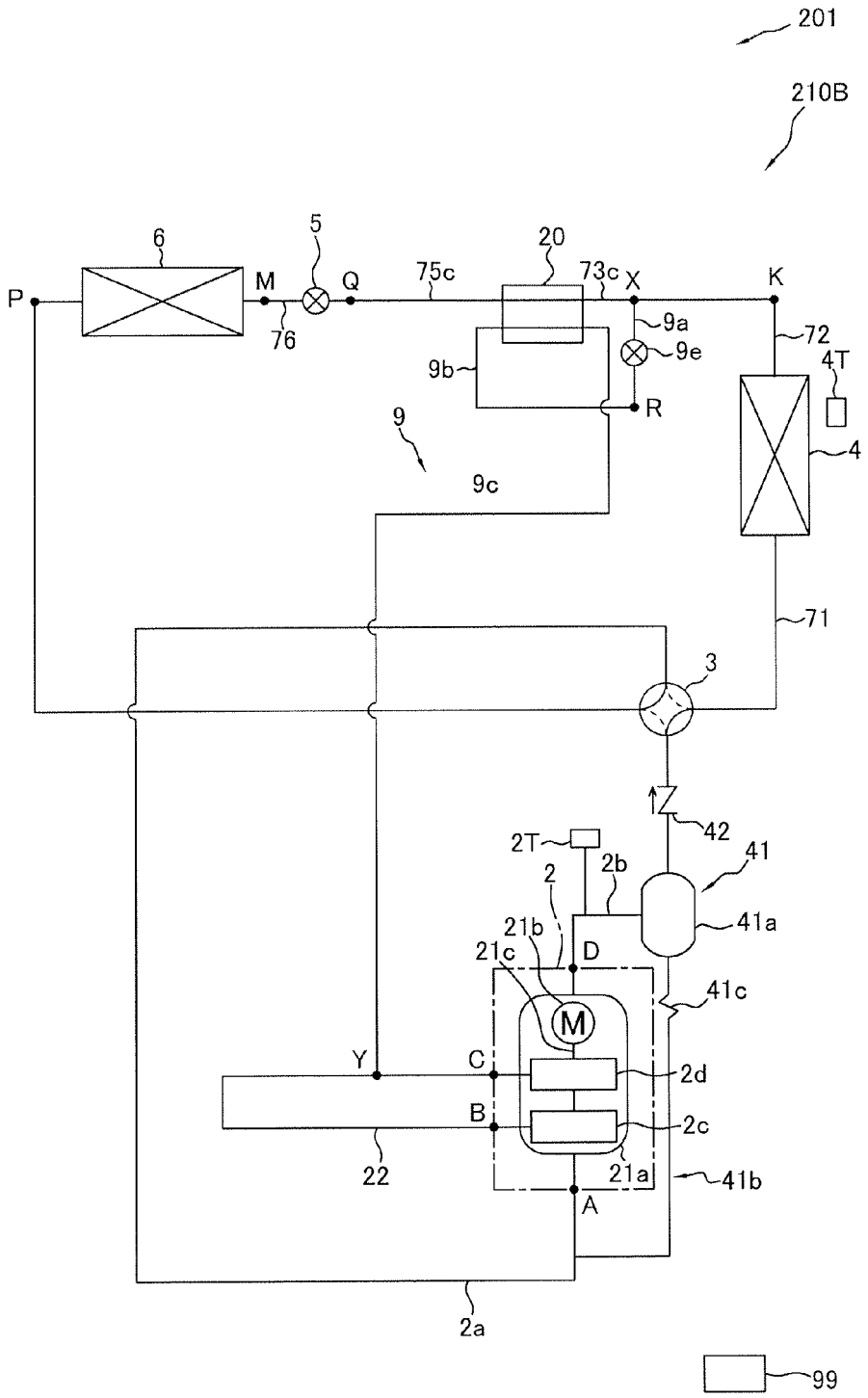
FIG. 10 is a general configuration diagram of an air conditioning apparatus pertaining to modification 2 of the second embodiment.

However, the present invention is not limited to this. For example, as shown in FIG. 10, the present invention may also employ a refrigerant circuit 210B that is further equipped with a switching mechanism 3 such that the heat source-side heat exchanger 4 can also function as an evaporator.

<2-5> Modification 3

In the above-described embodiment and modifications 1 and 2, a case where the controller 99 adjusts the opening degree of the economizer expansion mechanism 9*e* to switch between the economizer utilization state and the economizer non-utilization state has been taken as an example and described.

However, the present invention is not limited to this. For example, the controller 99 may also be configured to adjust the valve opening degree of the economizer expansion mechanism 9*e* to thereby control the flow rate ratio of the refrigerant flowing in the economizer circuit 9 and in the connecting pipes 73*c* and 75C.

<2-6> Modification 4

In the above-described embodiment, a case where, as means for lowering the degree of superheat of the refrigerant flowing through the intermediate refrigerant pipe 22, the refrigerant is injected into the intermediate refrigerant pipe 22 at the merge point Y through the economizer circuit 9 has been taken as an example and described.

Figure 11:
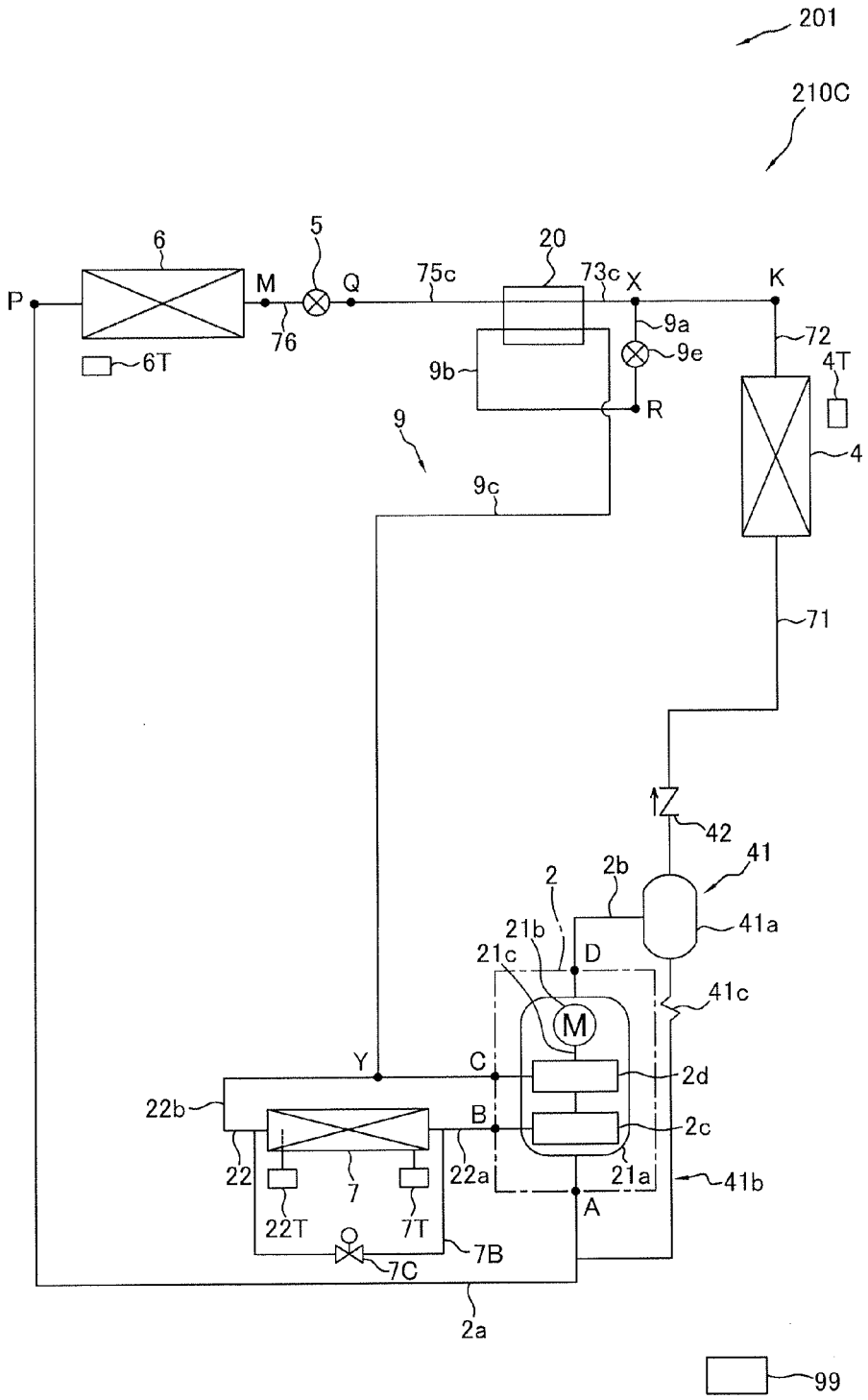
FIG. 11 is a general configuration diagram of an air conditioning apparatus pertaining to modification 3 of the second embodiment.

However, the present invention is not limited to this. For example, as shown in FIG. 11, the present invention may also employ a refrigerant circuit 210C in which the refrigerant flowing through the intermediate refrigerant pipe 22 is cooled by an intermediate cooler 7 having an external heat source.

Here, the intermediate refrigerant pipe 22 has a low stage-side intermediate refrigerant pipe 22*a*, which extends from the discharge side of the low stage-side compression element 2*c* to the intermediate cooler 7, and a high stage-side intermediate refrigerant pipe 22*b*, which extends from the suction side of the high stage-side compression element 2*d* to the intermediate cooler 7. Here, the merge point Y where the refrigerant is injected from the economizer circuit 9 to the intermediate refrigerant pipe 22 is disposed in the high stage-side intermediate refrigerant pipe 22*b*, and the refrigerant is injected through the economizer circuit 9 after the refrigerant has passed through the intermediate cooler 7. Further, an intermediate cooling bypass circuit 7B, which bypasses the intermediate cooler 7 and interconnects the low stage-side intermediate refrigerant pipe 22*a* and the high stage-side intermediate refrigerant pipe 22*b*, and an intermediate cooling bypass opening-and-closing valve 7C, which is disposed in the middle of this intermediate cooling bypass circuit 7B and is opened and closed, are also disposed. By opening this intermediate cooling bypass opening-and-closing valve 7C, the resistance of the refrigerant flow proceeding toward the intermediate cooler 7 becomes larger than the resistance of the refrigerant flowing through the intermediate cooling bypass circuit 7B, and the refrigerant flows mainly through the intermediate cooling bypass circuit 7B and can drop the function of the intermediate cooler 7. An intermediate cooling refrigerant temperature sensor 22T that detects the temperature of the refrigerant passing through the intermediate cooler 7 and an intermediate cooling external medium temperature sensor 7T that detects the temperature of an external cooling medium (water or air) passing through the intermediate cooler 7 are disposed. The controller 99 performs control to open and close the intermediate cooling bypass opening-and-closing valve 7C on the basis of the values detected by these temperature sensors and the like.

Figure 12:
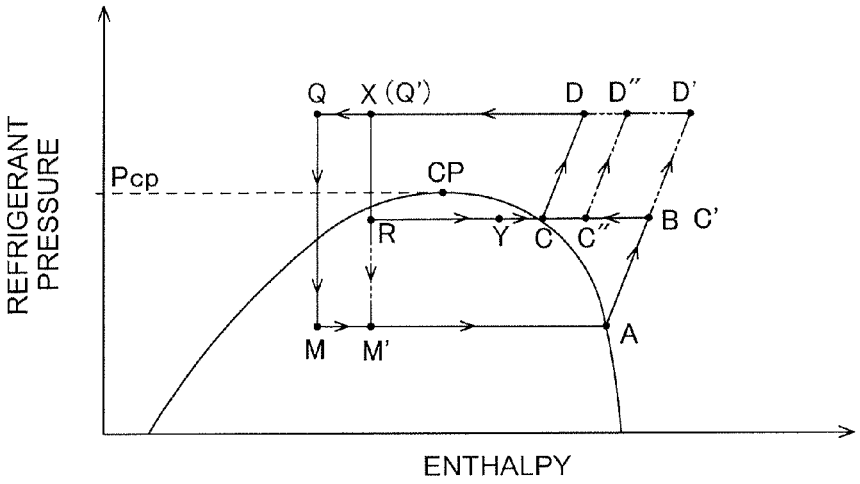
FIG. 12 is a pressure-enthalpy diagram in which the refrigeration cycle of the air conditioning apparatus pertaining to modification 3 of the second embodiment is shown.
Figure 13:
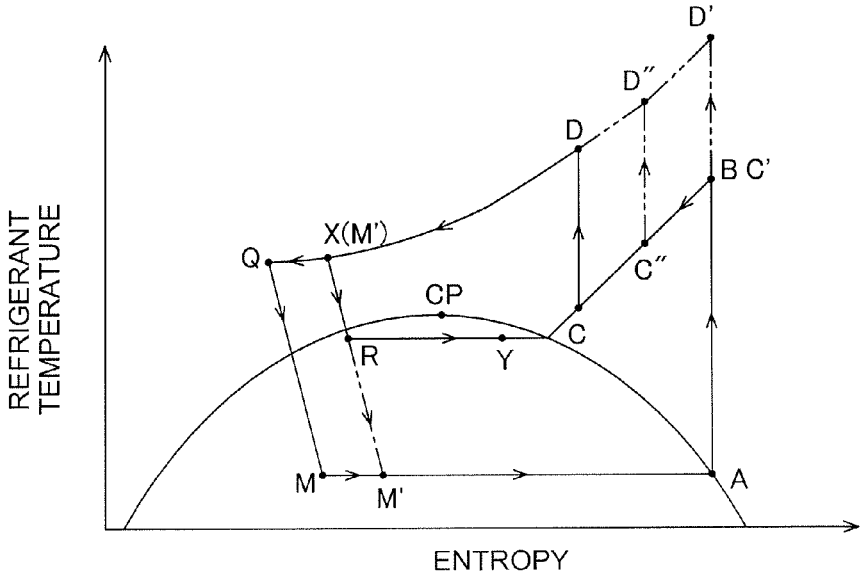
FIG. 13 is a temperature-entropy diagram in which the refrigeration cycle of the air conditioning apparatus pertaining to modification 3 of the second embodiment is shown.

Here, FIG. 12 is a pressure-enthalpy diagram in which the refrigeration cycle is shown, and FIG. 13 is a temperature-entropy diagram in which the refrigeration cycle is shown.

Here, in a state where the opening degree of the economizer expansion mechanism 9*e* is adjusted such that the refrigerant circuit 210C is placed in the economizer utilization state and where the intermediate cooler 7 is being utilized as a result of the intermediate cooling bypass opening-and-closing valve 7C being completely closed, the refrigeration cycle that follows point C and point D in FIG. 12 and FIG. 13 is executed, the density of the refrigerant sucked into the high stage-side compression element 2*d* rises, and compression efficiency improves.

Further, in a state where the opening degree of the economizer expansion mechanism 9*e* is adjusted such that the refrigerant circuit 210C is placed in the economizer utilization state and where the function of the intermediate cooler 7 is dropped as a result of the intermediate cooling bypass opening-and-closing valve 7C being completely opened, the refrigeration cycle that follows point C" and point D" in FIG. 12 and FIG. 13 is executed, and even when the load changes, the required quantity of heat to be radiated in the heat source-side heat exchanger 4 can be ensured while maintaining compression efficiency to a certain extent.

Further, in a state where the economizer expansion mechanism 9*e* is completely closed such that the refrigerant circuit 210C is placed in the economizer non-utilization state and where the function of the intermediate cooler 7 is dropped as a result of the intermediate cooling bypass opening-and-closing valve 7C being completely opened, the refrigeration cycle that follows point C' and point D' in FIG. 12 and FIG. 13 is executed, and even when the load changes, the required quantity of heat to be radiated in the heat source-side heat exchanger 4 can be ensured by raising the temperature of the refrigerant discharged from the high stage-side compression element 2*d*.

Here, description of a state where the economizer expansion mechanism 9*e* is completely closed such that the refrigerant circuit 210C is placed in the economizer non-utilization state and where the intermediate cooler 7 is being utilized as a result of the intermediate cooling bypass opening-and-closing valve 7C being completely closed is omitted, but it becomes close to the refrigeration cycle that follows point C" and point D" in FIG. 12 and FIG. 13.

In this manner, the controller 99 performs control of the economizer expansion mechanism 9*e* and the intermediate cooling bypass opening-and-closing valve 7C, such that the coefficient of performance becomes the best, on the premise of ensuring the required quantity of heat to be radiated in the heat source-side heat exchanger 4 on the basis of the values detected by the utilization-side temperature sensor 6T, the intermediate cooling refrigerant temperature sensor 22T, and the intermediate cooling external medium temperature sensor 7T.

<2-7> Modification 5

In the above-described embodiment and modifications 1 to 4, refrigerant circuits in which only one of the compression mechanism 2 with which the refrigerant is compressed in two stages is disposed have been taken as examples and described.

However, the present invention is not limited to this. For example, the present invention may also employ a refrigerant circuit where a plurality of the compression mechanisms 2 that perform compression in two stages as described above are disposed in parallel to each other.

Further, a plurality of the utilization-side heat exchangers 6 may also be placed in parallel to each other in the refrigerant circuit. In this case, the present invention may employ a refrigerant circuit where, in order to be able to control the quantity of the refrigerant supplied to each of the utilization-side heat exchangers 6, an expansion mechanism is placed just before each of the utilization-side heat exchangers so that the expansion mechanisms are also placed in parallel to each other.

<3> Third Embodiment

<3-1> Configuration of Air Conditioning Apparatus

Figure 14:
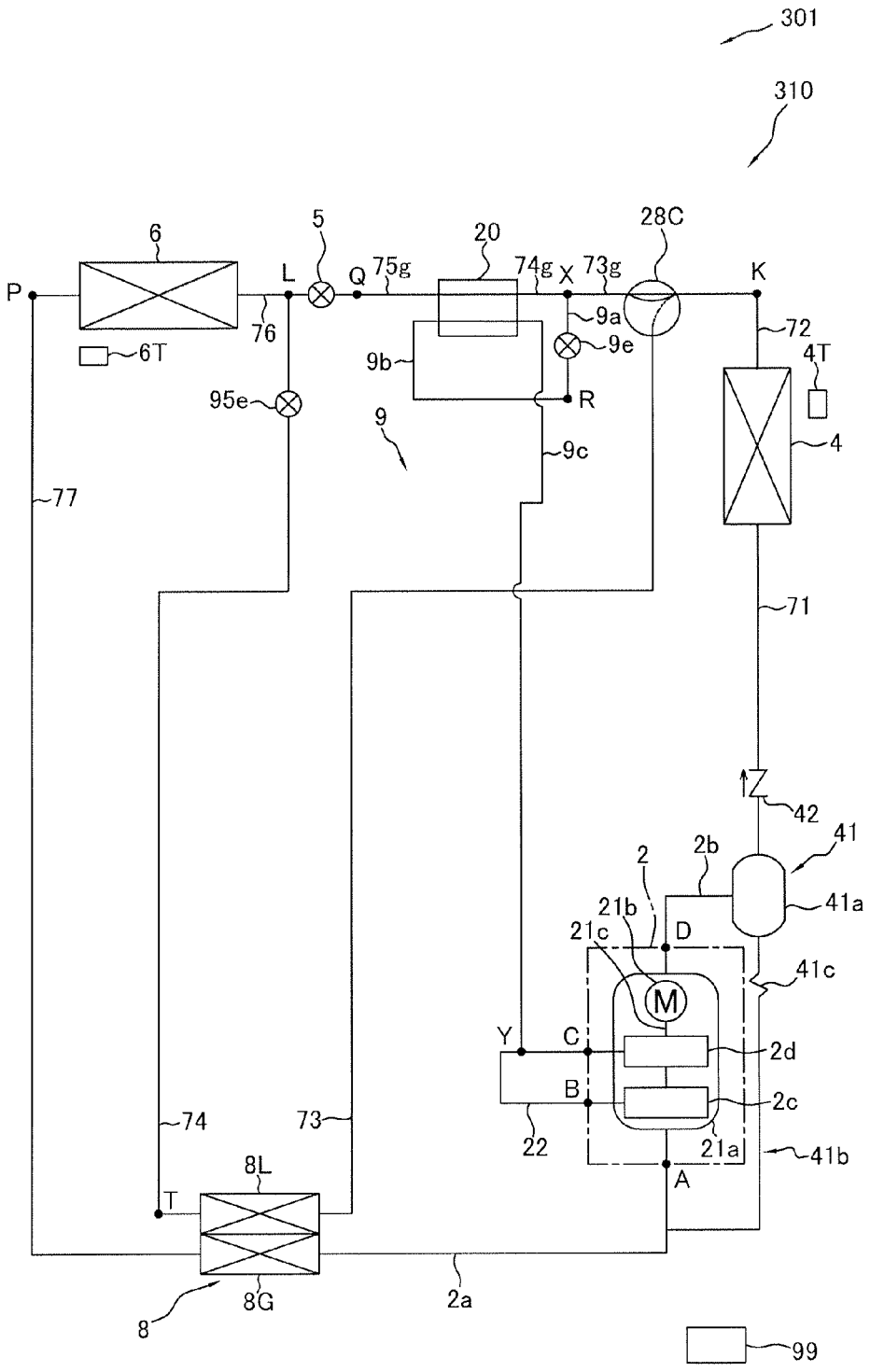
FIG. 14 is a general configuration diagram of an air conditioning apparatus serving as one embodiment of a refrigerating apparatus pertaining to a third embodiment of the present invention.

In an air conditioning apparatus 301 of a third embodiment, as shown in FIG. 14, there is employed a refrigerant circuit 310 in which both the liquid-gas heat exchanger 8 of the air conditioning apparatus 1 of the first embodiment and the economizer circuit 9 of the second embodiment are disposed. The air condition apparatus 301 will be described below centering on the points of difference among the above-described embodiments.

Here, a switching three-way valve 28C is disposed with respect to the connecting pipe 72. This switching three-way valve 28C can switch between an economizer state, where it is connected to a connecting pipe 73*g*, a liquid-gas state, where it is connected to the connecting pipe 73, and a non-utilization-of-either-function state, where neither the economizer circuit 9 nor the liquid-gas heat exchanger 8 is utilized.

The liquid-side liquid-gas heat exchanger 8L of the liquid-gas heat exchanger 8 is connected to this connecting pipe 73. The refrigerant that has passed through this liquid-side liquid-gas heat exchanger 8L flows via the connecting pipe 74 to a merge point L in the connecting pipe 76. An expansion mechanism 95e that reduces the pressure of the refrigerant is disposed in the middle of this connecting pipe 74.

Further, the connecting pipe 73*g* branches via the branch point X into a connecting pipe 74*g* side and the branch upstream pipe 9*a* side. This economizer circuit 9 itself is the same as that in the above-described embodiment. Additionally, the connecting pipe 74*g* is connected to a connecting pipe 75*g* through the economizer heat exchanger 20. The connecting pipe 75*g* is connected to the expansion mechanism 5. The expansion mechanism 5 is connected to the utilization-side heat exchanger 6 via the connecting pipe 76.

The remaining configuration is the same as the content described in regard to the air conditioning apparatus 1 of the first embodiment and the air conditioning apparatus 201 of the second embodiment.

<3-2> Operation of Air Conditioning Apparatus

Next, the operation of the air conditioning apparatus 301 of the present embodiment will be described using FIG. 14, FIG. 15, and FIG. 16.

Figure 15:
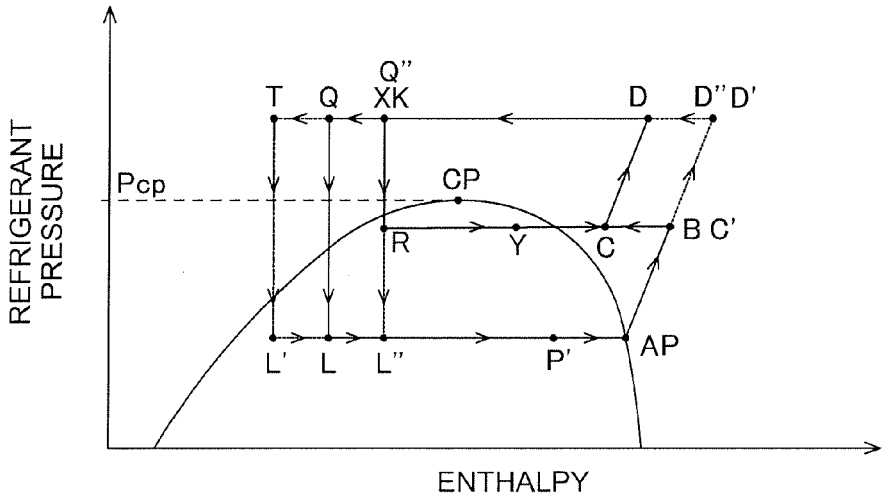
FIG. 15 is a pressure-enthalpy diagram in which the refrigeration cycle of the air conditioning apparatus pertaining to the third embodiment is shown.
Figure 16:
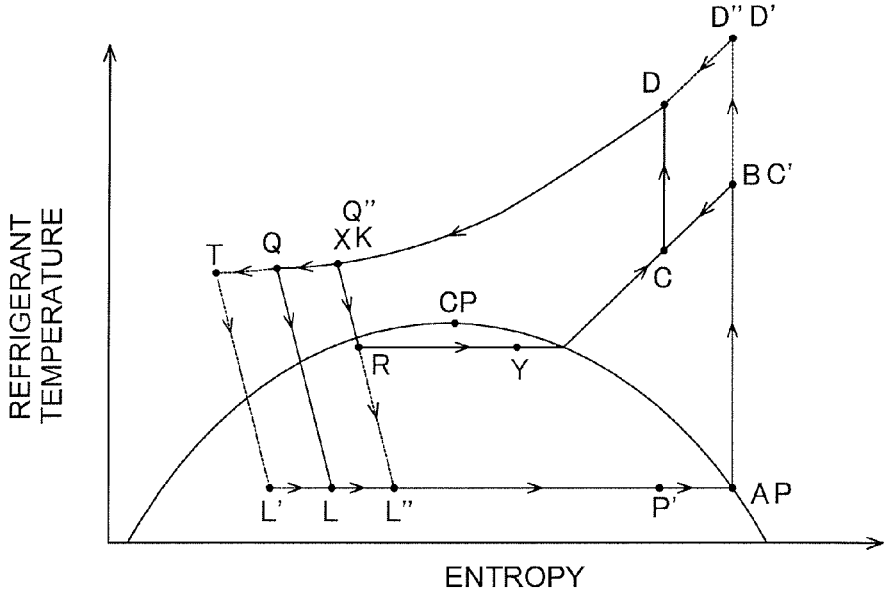
FIG. 16 is a temperature-entropy diagram in which the refrigeration cycle of the air conditioning apparatus pertaining to the third embodiment is shown.

Here, FIG. 15 is a pressure-enthalpy diagram in which the refrigeration cycle is shown, and FIG. 16 is a temperature-entropy diagram in which the refrigeration cycle is shown.

The specific enthalpy of point Q in the economizer state and the specific enthalpy of point T in the liquid-gas state are not limited to the example shown in FIG. 15 and FIG. 16, because whether either the specific enthalpy of point Q or that of point T will become large values will vary depending on control of the opening degrees of the expansion mechanism 5 and the expansion mechanism 95*e*.

(Economizer State)

In the economizer state, the controller 99 switches the state of connection of the switching three-way valve 28C, such that the refrigerant does not flow in the connecting pipe 73 and such that the refrigerant does flow in the connecting pipe 73*g*, and raises the opening degree of the economizer expansion mechanism 9*e* to allow the refrigerant to flow in the economizer circuit 9, and performs the refrigeration cycle. Here, the same refrigeration cycle as in the economizer utilization state in the second embodiment is performed as indicated by point A, point B, point C, point D, point K, point X, point R, point Y, point Q, point L, and point P in FIG. 14, FIG. 15, and FIG. 16.

Here, the specific enthalpy of the refrigerant that passes through the connecting pipe 75*g* and flows into the expansion mechanism 5 can be lowered by the heat exchange in the economizer heat exchanger 20, and the refrigerating capacity of the refrigeration cycle can be improved to make the coefficient of performance into a good value. Moreover, the degree of superheat of the refrigerant sucked into the high stage-side compression element 2*d* of the compression mechanism 2 can be made small by the refrigerant that is merged together in the merge point Y of the intermediate refrigerant pipe 22 through the economizer circuit 9, the density of the refrigerant sucked into the compression element 2*d* can be raised to improve compression efficiency, and an abnormal rise in the temperature of the discharged refrigerant can be prevented. Further, at this time, the refrigerant is injected into the intermediate refrigerant pipe 22 via the economizer circuit 9, whereby the quantity of the refrigerant that is supplied to the heat source-side heat exchanger 4 increases, and the quantity of heat that is supplied can also be increased.

(Liquid-Gas State)

In the liquid-gas state, the controller 99 switches the state of connection of the switching three-way valve 28C, such that the refrigerant does not flow in the connecting pipe 73*g* and such that the refrigerant does flow in the connecting pipe 73, and performs the refrigeration cycle that causes the liquid-gas heat exchanger 8 to function. Here, the same refrigeration cycle as the liquid-gas utilization state of connection in the first embodiment is performed as indicated by point A, point B, point C', point D', point K, point T, point L', and point P' in FIG. 14, FIG. 15, and FIG. 16.

Here, the specific enthalpy of the refrigerant flowing into the expansion mechanism 95*e* can be lowered, so the refrigerating capacity in the refrigeration cycle can be improved to make the coefficient of performance into a good value, the degree of superheat of the refrigerant sucked into the low stage-side compression element 2*c* of the compression mechanism 2 can be ensured to prevent liquid compression, and the discharge temperature can be raised to ensure the required quantity of heat in the heat source-side heat exchanger 4.

(Non-Utilization-of-Either-Function State)

In the non-utilization-of-either-function state, the controller 99 switches the state of connection of the switching three-way valve 28C, such that the refrigerant does not flow in the connecting pipe 73 and such that the refrigerant does flow in the connecting pipe 73*g*, places the economizer expansion mechanism 9*e* in a completely closed state, and performs the refrigeration cycle such that neither the economizer circuit 9 nor the liquid-gas heat exchanger 8 is utilized. Here, a simple refrigeration cycle such as indicated by point A, point B, point C, point D", point K, point X, point Q", point L", and point P in FIG. 14, FIG. 15, and FIG. 16 is performed.

Here, the temperature of the refrigerant discharged from the high stage-side compression element 2*d* of the compression mechanism 2 can be made high, so even when the required quantity of heat to be radiated in the heat source-side heat exchanger 4 has increased, the required quantity of heat can be supplied.

(Target Capacity Output Control)

In this refrigeration cycle, the controller 99 performs target capacity output control described below.

First, the controller 99 calculates, on the basis of the input value of a temperature setting inputted by a user via an unillustrated controller or the like and the air temperature of the space where the heat source-side heat exchanger 4 is placed which is detected by the heat source-side temperature sensor 4T, a required quantity of heat to be radiated in the space where the heat source-side heat exchanger 4 is disposed. The controller 99 also calculates, on the basis of this required quantity of heat to be radiated, a target discharge pressure in regard to the pressure of the refrigerant discharged from the compression mechanism 2.

Here, a case where the controller 99 uses the target discharge pressure for the target value in the target capacity output control is taken as an example and described, but in addition to this target discharge pressure, for example, the controller 99 may also be configured to set target values for the discharged refrigerant pressure and the discharged refrigerant temperature set such that a value obtained by multiplying the discharged refrigerant pressure by the discharged refrigerant temperature falls within a predetermined range. Here, this is because when the load has changed, the density of the discharged refrigerant ends up becoming low when the degree of superheat of the sucked-in refrigerant is high, so even if the controller 99 is able to maintain the temperature of the refrigerant discharged from the high stage-side compression element 2*d*, there is the fear that the controller 99 will end up becoming unable to ensure the required quantity of heat to be radiated in the heat source-side heat exchanger 4.

Next, the controller 99 sets, on the basis of the temperature detected by the utilization-side temperature sensor 6T, a target evaporation temperature and a target evaporation pressure (a pressure equal to or lower than the critical pressure). Setting of this target evaporation pressure is performed each time the temperature detected by the utilization-side temperature sensor 6T changes.

Further, the controller 99 performs, on the basis of the value of this target evaporation temperature, degree of superheat control such that the degree of superheat of the refrigerant sucked in by the compression mechanism 2 becomes a target value x (a target value of superheat degree).

Then, in the compression process, the controller 99 controls the operational capacity of the compression mechanism 2 so as to raise the temperature of the refrigerant until the pressure of the refrigerant reaches the target discharge pressure while causing an isentropic change that maintains the value of entropy at the degree of superheat that has been set in this manner. Here, the controller 99 controls the operational capacity of the compression mechanism 2 by rotating speed control. The discharge pressure of the compression mechanism 2 is controlled such that it becomes a pressure exceeding the critical pressure.

Here, in the radiation process in the heat source-side heat exchanger 4, the refrigerant is in a supercritical state, so the temperature of the refrigerant continuously falls while the refrigerant undergoes an isobaric change with the pressure of the refrigerant being maintained at the target discharge pressure. Additionally, the refrigerant flowing through the heat source-side heat exchanger 4 is cooled to a value y that is equal to or higher than the temperature of the water or air supplied as a heating target and close to the temperature of this water or air supplied as a heating target. Here, the value of y is decided as a result of the supply quantity of the heating target supplied by an unillustrated heating target supply device (a pump in the case of water, a fan in the case of air, etc.) being controlled.

Here, when the refrigerant circuit 310 is controlled in the economizer state, the temperature of the refrigerant that has flowed from the connecting pipe 73*g* into the economizer heat exchanger 20 further continuously falls while the refrigerant undergoes an isobaric change with the pressure of the refrigerant being maintained at the target discharge pressure, and the refrigerant is sent to the connecting pipe 75*g*. Thus, the refrigerating capacity in the refrigeration cycle improves, so the coefficient of performance becomes better. Further, the temperature of the refrigerant that flows through the intermediate refrigerant pipe 22 and is sucked into the high stage-side compression element 2*d* is lowered by the injection of the refrigerant that has passed through the economizer circuit 9, whereby an abnormal rise in the temperature of the refrigerant discharged from the high stage-side compression element 2*d* can be prevented. Further, in this economizer state, as in the liquid-gas non-utilization state of connection in the first embodiment described above, heat exchange in the liquid-gas heat exchanger 8 is not performed, so the degree of superheat of the refrigerant sucked into the compression mechanism 2 can be prevented from becoming too high. Thus, even if the refrigerant discharged from the compression mechanism 2 is given the target discharge pressure, the temperature of the discharged refrigerant can be prevented from rising too much, and the reliability of the compression mechanism 2 can be improved.

Moreover, here, when the refrigerant circuit 310 is controlled in the liquid-gas state, the temperature of the refrigerant further continuously falls while the refrigerant undergoes an isobaric change with the pressure of the refrigerant being maintained at the target discharge pressure. Thus, the refrigerating capacity in the refrigeration cycle improves, so the coefficient of performance becomes better. Further, in this liquid-gas state, as in the economizer non-utilization state in the second embodiment described above, heat exchange in the economizer heat exchanger 20 is not performed, so the temperature of the refrigerant sucked into the high stage-side compression element 2*d* does not fall, and the required quantity of heat to be radiated in the heat source-side heat exchanger 4 can be ensured.

The refrigerant that has been cooled in the heat source-side heat exchanger 4 (and in the liquid-gas heat exchanger 8) in this manner has its pressure reduced by the expansion mechanism 5 in the case of the economizer state or by the expansion mechanism 95*e* in the case of the liquid-gas state until it becomes the target evaporation pressure (a pressure equal to or lower than the critical pressure) and flows into the utilization-side heat exchanger 6.

The refrigerant flowing through the utilization-side heat exchanger 6 absorbs heat from the water or air supplied as a heating source, whereby the quality of wet vapor of the refrigerant is improved while the refrigerant undergoes an isothermal-isobaric change while maintaining the target evaporation temperature and the target evaporation pressure. Additionally, the controller 99 controls the supply quantity of the heating source supplied by the unillustrated heating source supply device (a pump in the case of water, a fan in the case of air, etc.) such that the degree of superheat becomes the degree of superheat target value.

In performing control in this manner, the controller 99 calculates the value of x and the value of y and performs the above-described target capacity output control such that the coefficient of performance (COP) in the refrigeration cycle becomes the highest in each of the economizer state and the liquid-gas state. Here, in calculating the value of x and the value of y in which the coefficient of performance will become the best, the controller 99 performs the calculation on the basis of the physicality of the carbon dioxide serving as the working refrigerant (a Mollier diagram or the like).

The controller 99 may also be configured to set a condition in which it can maintain the coefficient of performance at a good level to a certain extent and, if this condition is met, to obtain the value of x and the value of y such that the compression work becomes a smaller value. Further, the controller 99 may also be configured to use keeping the compression work equal to or less than a predetermined value as a precondition and to obtain the value of x and the value of y with which the coefficient of performance will become the best amid meeting this precondition.

In performing control in this manner, the controller 99 calculates the value of x and the value of y and performs the above-described target capacity output control such that the coefficient of performance (COP) in the refrigeration cycle becomes the highest. Here, in calculating the value of x and the value of y with which the coefficient of performance will become the best, the controller 99 performs the calculation on the basis of the physicality of the carbon dioxide serving as the working refrigerant (a Mollier diagram or the like).

The controller 99 may also be configured to set a condition in which it can maintain the coefficient of performance at a good level to a certain extent and, if this condition is met, to obtain the value of x and the value of y such that the compression work becomes a smaller value. Further, the controller 99 may also be configured to use keeping the compression work equal to or less than a predetermined value as a precondition and to obtain the value of x and the value of y with which the coefficient of performance will become the best amid meeting this precondition.

(Control for Switching Between Economizer State, Liquid-Gas State, and Non-Utilization-of-Either-Function State)

The controller 99 performs control to switch between the above-described states such that it gives the highest priority to the temperature of the refrigerant discharged from the compression mechanism 2 being in a range where it will not abnormally rise, gives second priority to being able to supply the required quantity of heat to be radiated in the heat source-side heat exchanger 4, and gives third priority to making operational efficiency good (being able to appropriately decide in terms of a balance between improving the coefficient of performance and raising compression efficiency).

That is, when the quantity of heat to be radiated in the heat source-side heat exchanger 4 is insufficient, the controller 99 performs control to switch to the liquid-gas state if the discharge temperature is in the range where it will not abnormally rise and to switch to the non-utilization-of-either-function state if it is to avoid the discharge temperature abnormally rising. Further, when the quantity of heat to be radiated in the heat source-side heat exchanger 4 is sufficient, the controller 99 switches to the economizer state, controls the opening degree of the economizer expansion mechanism 9*e*, raises the valve opening degree to an extent that it can supply the required quantity of heat in the heat source-side heat exchanger 4, improves the refrigerating capacity of the refrigeration cycle to thereby make the coefficient of performance into a good value, and increases the quantity of the refrigerant that can be supplied to the heat source-side heat exchanger 4 to thereby increase the supplied quantity of heat.

In regard to the quantity of heat to be radiated here, the controller 99 obtains this on the basis of the temperature detected by the heat source-side temperature sensor 4T and the temperature setting. Further, in regard to whether or not the discharge temperature is not abnormally rising, the controller 99 determines this on the basis of (the evaporation temperature that is set in correspondence to) the temperature detected by the utilization-side temperature sensor 6T.

<3-3> Modification 1

In the above-described embodiment, a case where the controller 99 performs control to switch between the economizer state, the liquid-gas state, and the non-utilization-of-either-function state has been taken as an example and described.

However, the present invention is not limited to this. For example, the present invention may also be configured such that it can employ a combination state that also utilizes the liquid-gas heat exchanger 8 while utilizing the economizer circuit 9.

Here, for example, the controller 99 may be configured such that, rather than simply alternately switching the state of connection of the switching three-way valve 28C, it controls the ratio between the flow rate of the refrigerant flowing through the economizer circuit 9 side and the flow rate of the refrigerant flowing through in the liquid-gas heat exchanger 8L in a situation where the refrigerant simultaneously flows in both the economizer circuit 9 and the liquid-gas heat exchanger 8L so that it can make operational efficiency good (can appropriately decide in terms of a balance between improving the coefficient of performance and raising compression efficiency) as a precondition in which the temperature of the refrigerant discharged from the compression mechanism 2 is not in a range where it will abnormally rise (a range where it ends up causing the refrigerator machine oil to deteriorate) but the discharge pressure is equal to or less than a predetermined pressure corresponding to the pressure capacity of the compression mechanism 2 and the controller 99 is able to supply the required quantity of heat to be radiated in the heat source-side heat exchanger 4. The ratio-adjustable configuration here is not limited to the switching three-way valve 28C. For example, an expansion mechanism may be disposed just before the liquid-gas heat exchanger 8L, and the controller 99 may perform flow rate ratio control.

Here, regarding the ratio between the flow rate on the economizer circuit 9 side and the flow rate on the liquid-gas heat exchanger 8 side, the controller 99 calculates only the quantity of heat with which it can ensure that the temperature of the refrigerant discharged from the compression mechanism 2 in a case where the target evaporation temperature has been set on the basis of the temperature detected by the utilization-side temperature sensor 6T is in a range where it will not abnormally rise (under a condition in which the temperature of the refrigerant discharged from the high stage-side compression element 2*d* is equal to or less than a predetermined temperature) and can ensure the required quantity of heat to be radiated in the heat source-side heat exchanger 4.

Then, for example, the controller 99 first assumes that the flow rate in the economizer circuit 9 is zero and calculates the flow rate in the liquid-gas heat exchanger 8L that is needed so that it can prevent an abnormal rise in the temperature of the discharged refrigerant at the target evaporation temperature and in order to ensure that the discharge pressure is equal to or less than the predetermined pressure corresponding to the pressure capacity of the compression mechanism 2 and ensure the quantity of heat to be radiated. Next, the controller 99 reduces this calculated flow rate on the liquid-gas heat exchanger 8L side, assumes that refrigerant corresponding to the reduced flow rate has flowed in the economizer circuit 9, and, considering the drop in the refrigerating capacity resulting from the specific enthalpy increasing in accompaniment with the flow rate in the liquid-gas heat exchanger 8 decreasing, the increase in the refrigerating capacity resulting from the specific enthalpy falling in accompaniment with the flow rate in the economizer circuit 9 increasing, the increase in the compression ratio of the compression mechanism resulting from high pressure rising in order to ensure the quantity of heat to be radiated because the flow rate in the economizer circuit 9 increases, and the increase in the supplied quantity of heat accompanying the density of the refrigerant supplied to the heat source-side heat exchanger 4 rising because of the increase in the flow rate in the economizer circuit 9, the controller 99 controls the flow rate ratio such that the compression ratio of each of the low stage-side compression element 2*c* and the high stage-side compression element 2*d* of the compression mechanism 2 is within a predetermined range and such that the coefficient of performance is within a predetermined range.

For example, in the flow rate ratio control by the controller 99, the controller 99 may be configured to calculate, as an intermediate pressure that minimizes the compression work, an intermediate pressure where the compression ratio resulting from the low stage-side compression element 2*c* and the compression ratio resulting from the high stage-side compression element 2*d* become equal, control the economizer expansion mechanism 9*e* such that the extent to which the pressure of the refrigerant is reduced in the economizer expansion mechanism 9*e* becomes this intermediate pressure (and a pressure in a predetermined range from this intermediate pressure), and adjust the flow rate ratio in the switching three-way valve 28C such that the coefficient of performance becomes good.

<3-4> Modification 2

In the above-described embodiment, a case where the controller 99 switches the opening degrees of the switching three-way valve 28C and the economizer expansion mechanism 9*e* on the basis of the temperature detected by the utilization-side temperature sensor 6T (on the basis of the target evaporation temperature that is set) has been taken as an example and described.

Figure 17:
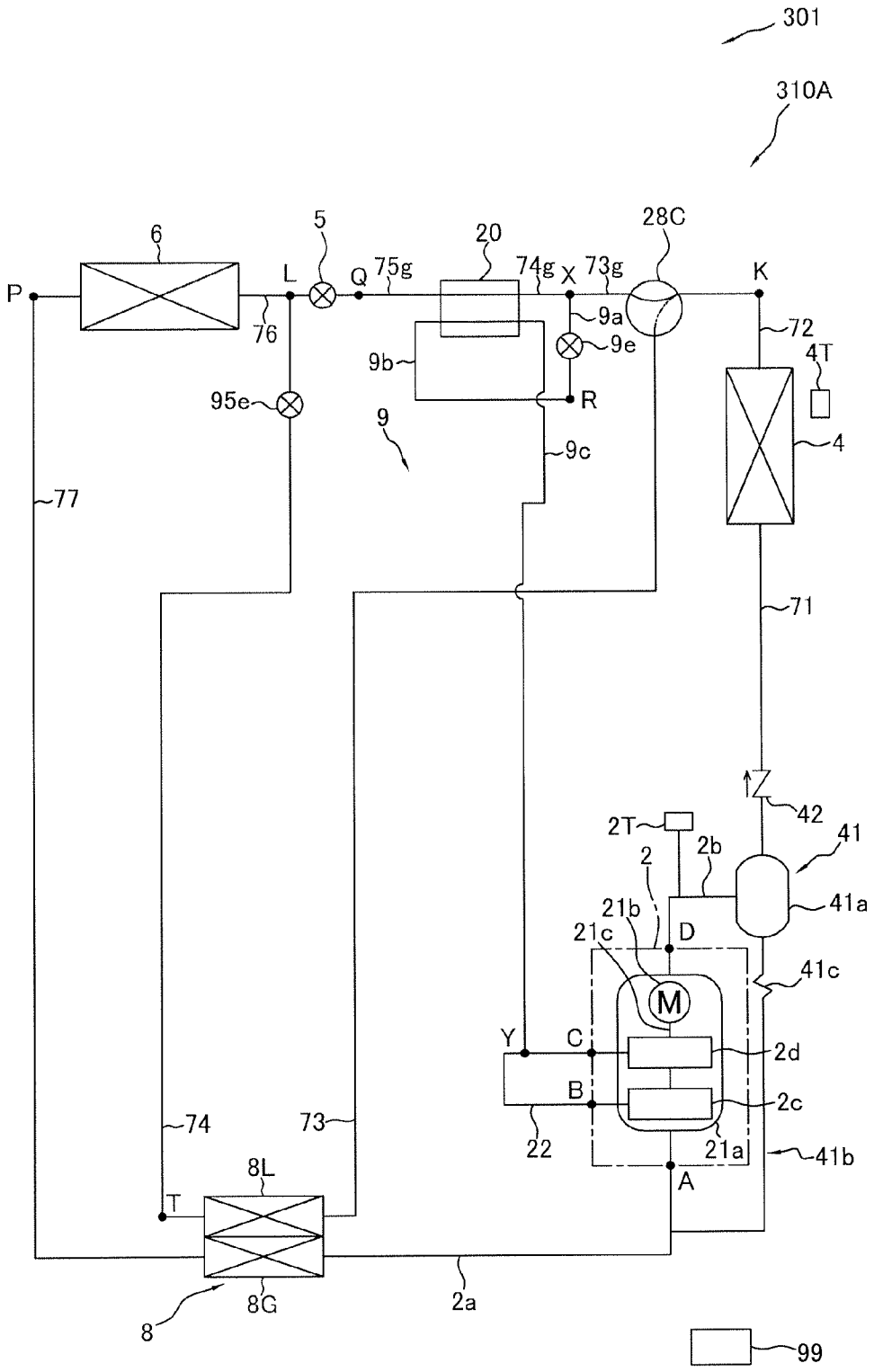
FIG. 17 is a general configuration diagram of an air conditioning apparatus pertaining to modification 2 of the third embodiment.

However, the present invention is not limited to this. For example, as shown in FIG. 17, a refrigerant circuit 310A that has, instead of the utilization-side temperature sensor 6T, a discharged refrigerant temperature sensor 2T that detects the temperature of the refrigerant discharged from the compression mechanism 2 may also be employed.

In this discharged refrigerant temperature sensor 2T, the case described above where the temperature detected by the utilization-side temperature sensor 6T becomes high corresponds to a case where the temperature detected by the discharged refrigerant temperature sensor 2T becomes low, and the case described above where the temperature detected by the utilization-side temperature sensor 6T becomes low corresponds to a case where the temperature detected by the discharged refrigerant temperature sensor 2T becomes high.

<3-5> Modification 3

In the above-described embodiment, a case where the heat source-side heat exchanger 4 functions as a radiator has been taken as an example and described.

Figure 18:
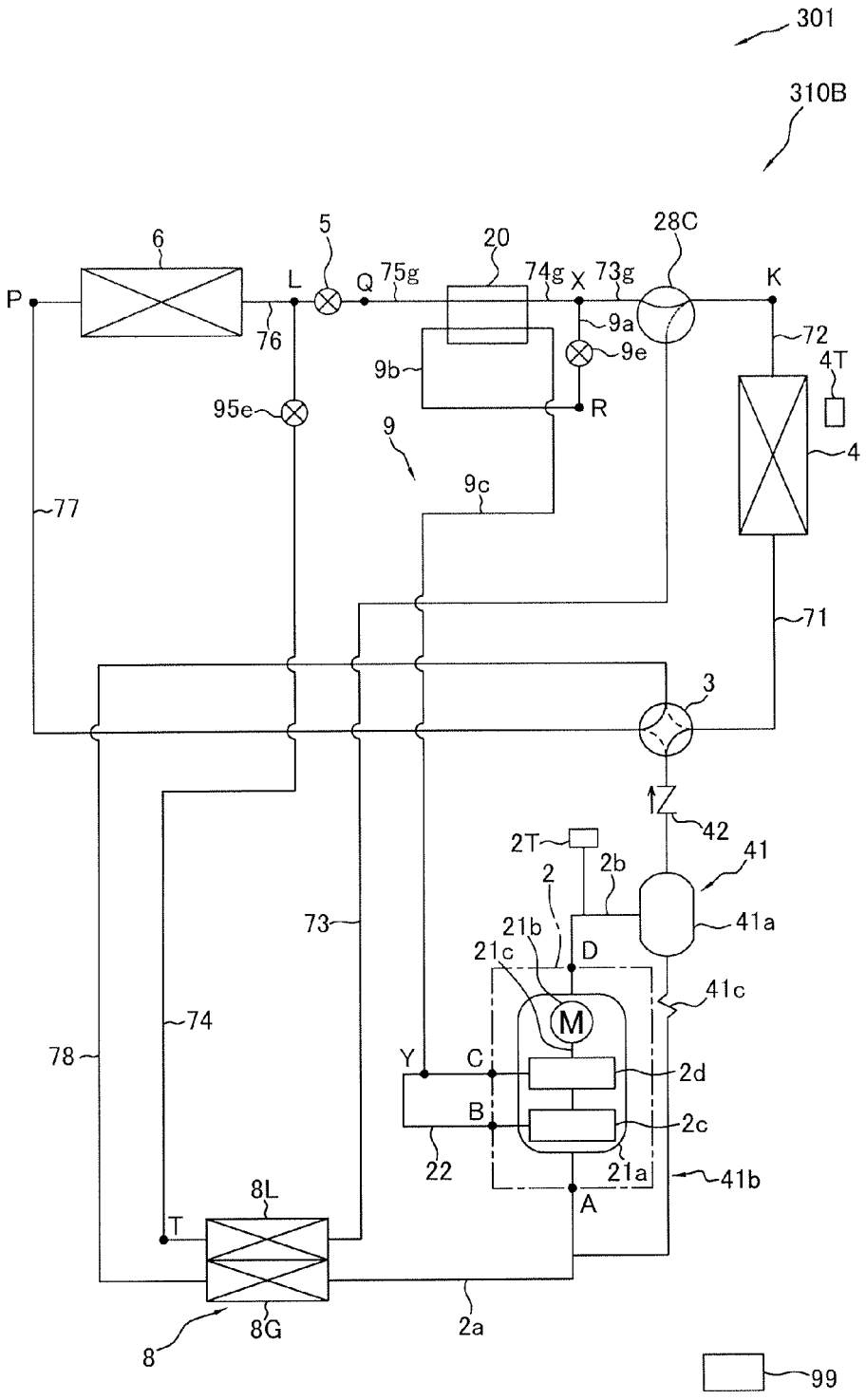
FIG. 18 is a general configuration diagram of an air conditioning apparatus pertaining to modification 3 of the third embodiment.

However, the present invention is not limited to this. For example, as shown in FIG. 18, the present invention may also employ a refrigerant circuit 310B that is further equipped with a switching mechanism 3 such that the heat source-side heat exchanger 4 can also function as an evaporator.

<3-6> Modification 4

In the above-described embodiment and modifications 1 to 3, a case where the controller 99 switches the state of connection of the switching three-way valve 28C to switch between the liquid-gas state, the economizer state, and the non-utilization-of-either-function state has been taken as an example and described.

However, the present invention is not limited to this. For example, the present invention may also employ a refrigerant circuit where, instead of the switching three-way valve 28C, an opening-and-closing valve is disposed in the connecting pipe 73*g* and an opening-and-closing valve is also disposed in the connecting pipe 73.

<3-7> Modification 5

In the above-described embodiment, the refrigerant circuit 310 in which both the expansion mechanism 5 and the expansion mechanism 95*e* are disposed has been taken as an example and described.

Figure 19:
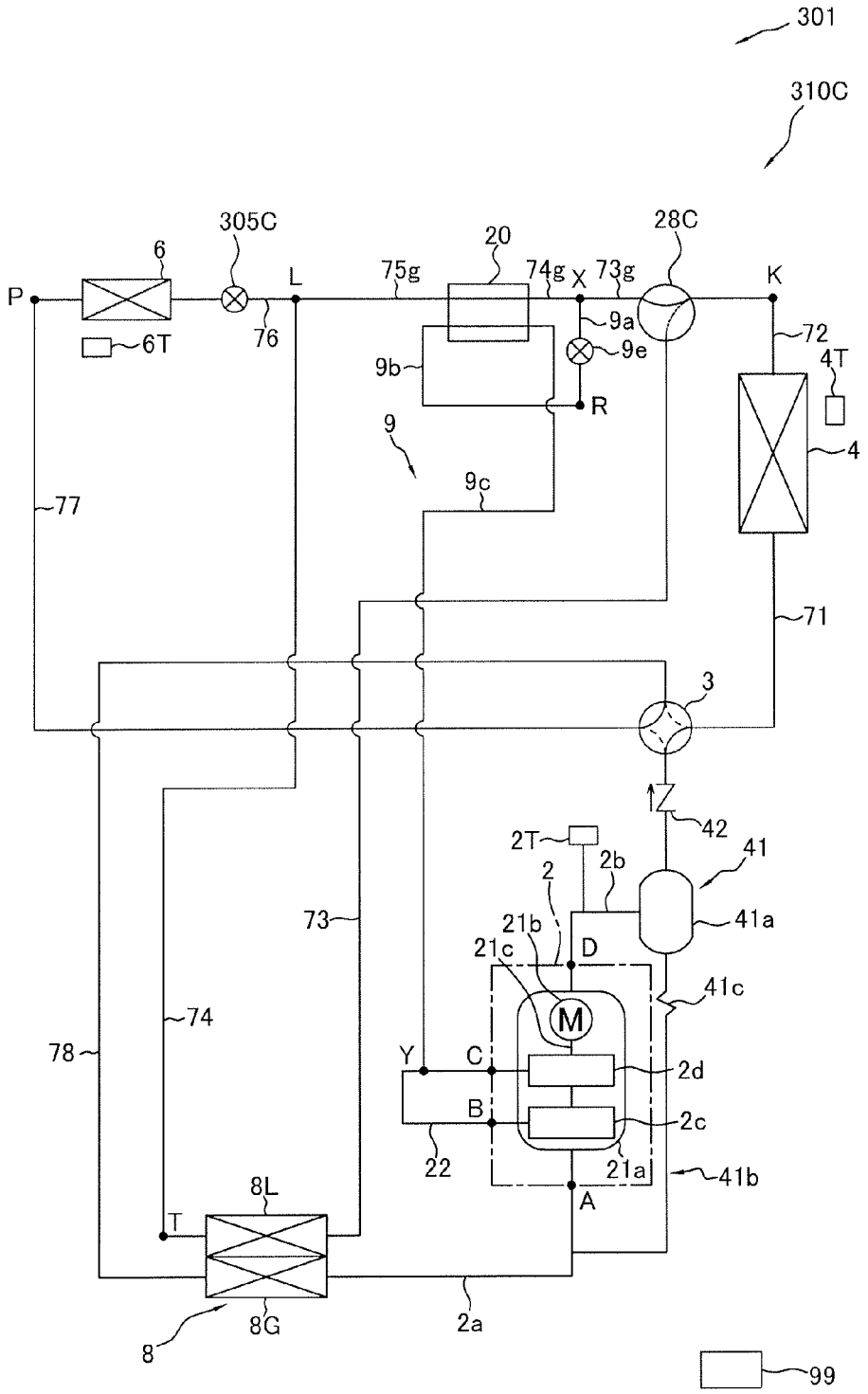
FIG. 19 is a general configuration diagram of an air conditioning apparatus pertaining to modification 5 of the third embodiment.

However, the present invention is not limited to this. For example, as shown in FIG. 19, the present invention may also employ a refrigerant circuit 310C that has a combination expansion mechanism 305C that can be used both when the controller 99 controls the refrigerant circuit 310C in the economizer state and when the controller 99 controls the refrigerant circuit 310C in the liquid-gas state.

In this case, the number of expansion mechanisms can be reduced less than these of the refrigerant circuit 310 in the above-described third embodiment.

<3-8> Modification 6

In the above-described embodiment, the refrigerant circuit 310 in which the branch point X that branches to the economizer circuit 9 is bypassed by the liquid-gas heat exchanger 8 has been taken as an example and described.

Figure 20:
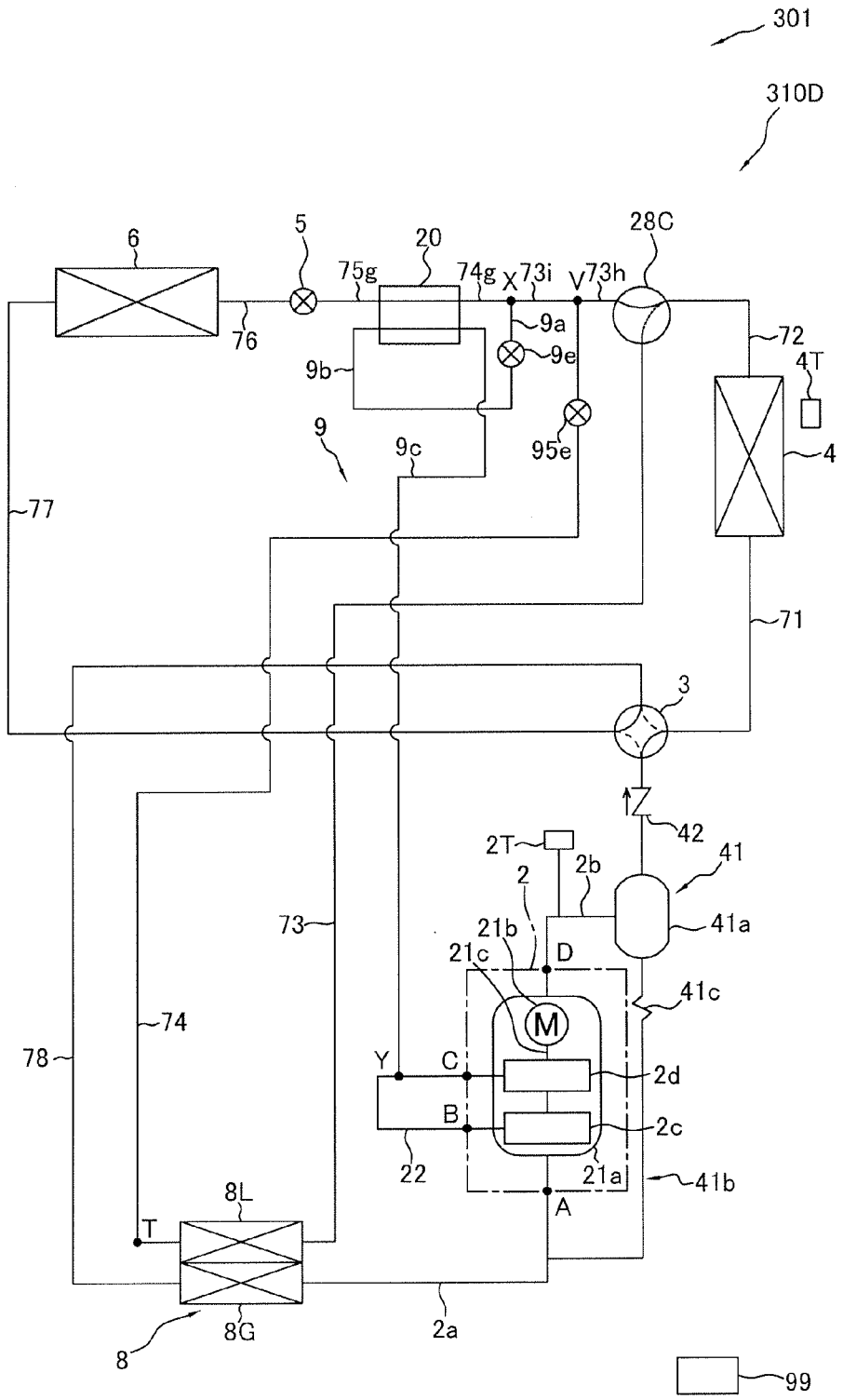
FIG. 20 is a general configuration diagram of an air conditioning apparatus pertaining to modification 6 of the third embodiment.

However, the present invention is not limited to this. For example, as shown in FIG. 20, the present invention may also employ a refrigerant circuit 310D that is configured such that the return refrigerant that has passed through the liquid-gas heat exchanger 8L is allowed to merge together at a merge point V between a connecting pipe 73h extending from the switching three-way valve 28C that sends the refrigerant to the liquid-gas heat exchanger 8 and a connecting pipe 73i that extends from the branch point X that sends the refrigerant to the economizer circuit 9.

<3-9> Modification 7

Figure 21:
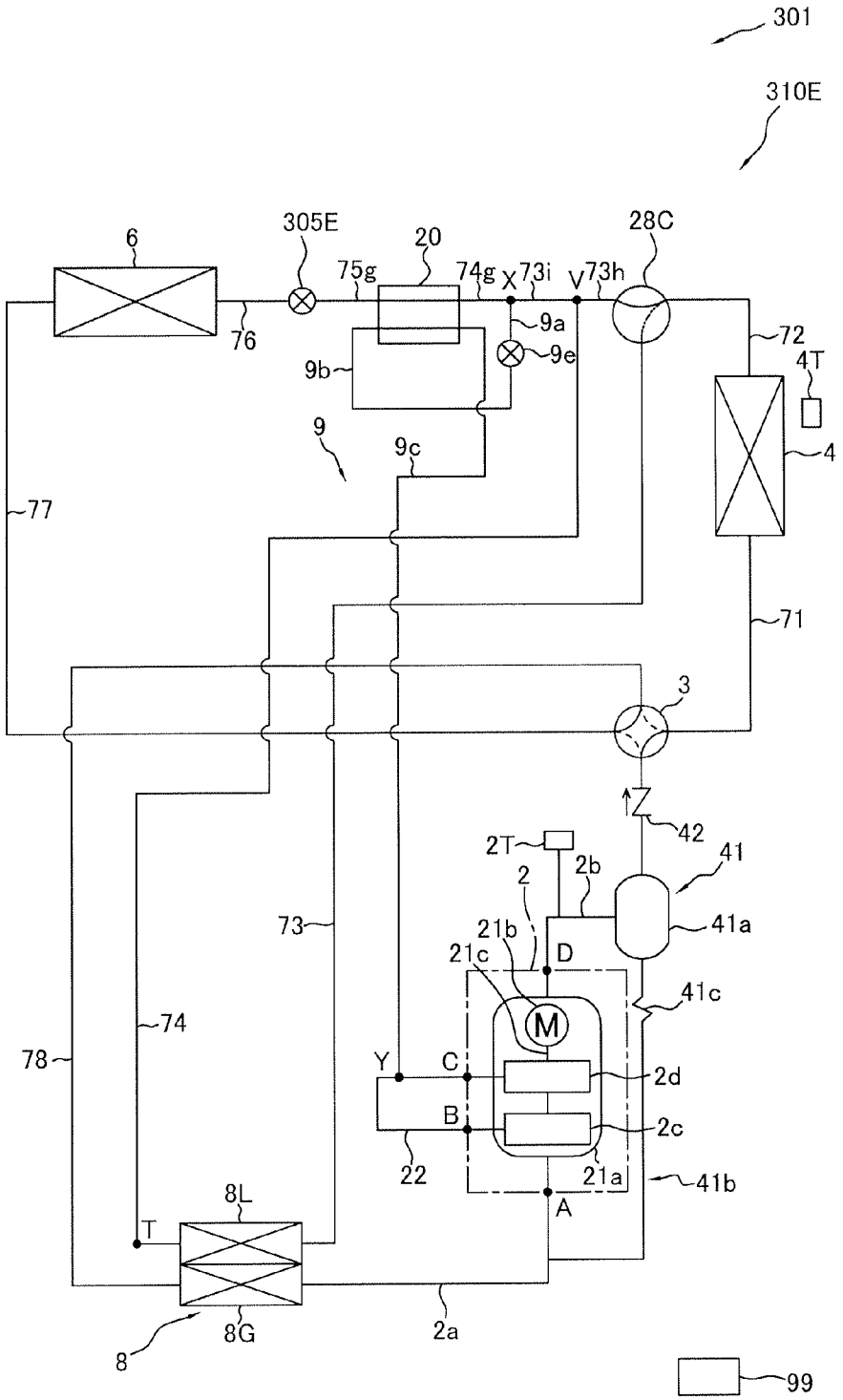
FIG. 21 is a general configuration diagram of an air conditioning apparatus pertaining to modification 7 of the third embodiment.

Moreover, as shown in FIG. 21, the present invention may also employ a refrigerant circuit 310E that has an expansion mechanism 305E in which the expansion mechanism 5 and the expansion mechanism 95*e* in the refrigerant circuit 310D are shared.

<3-10> Modification 8

Figure 22:
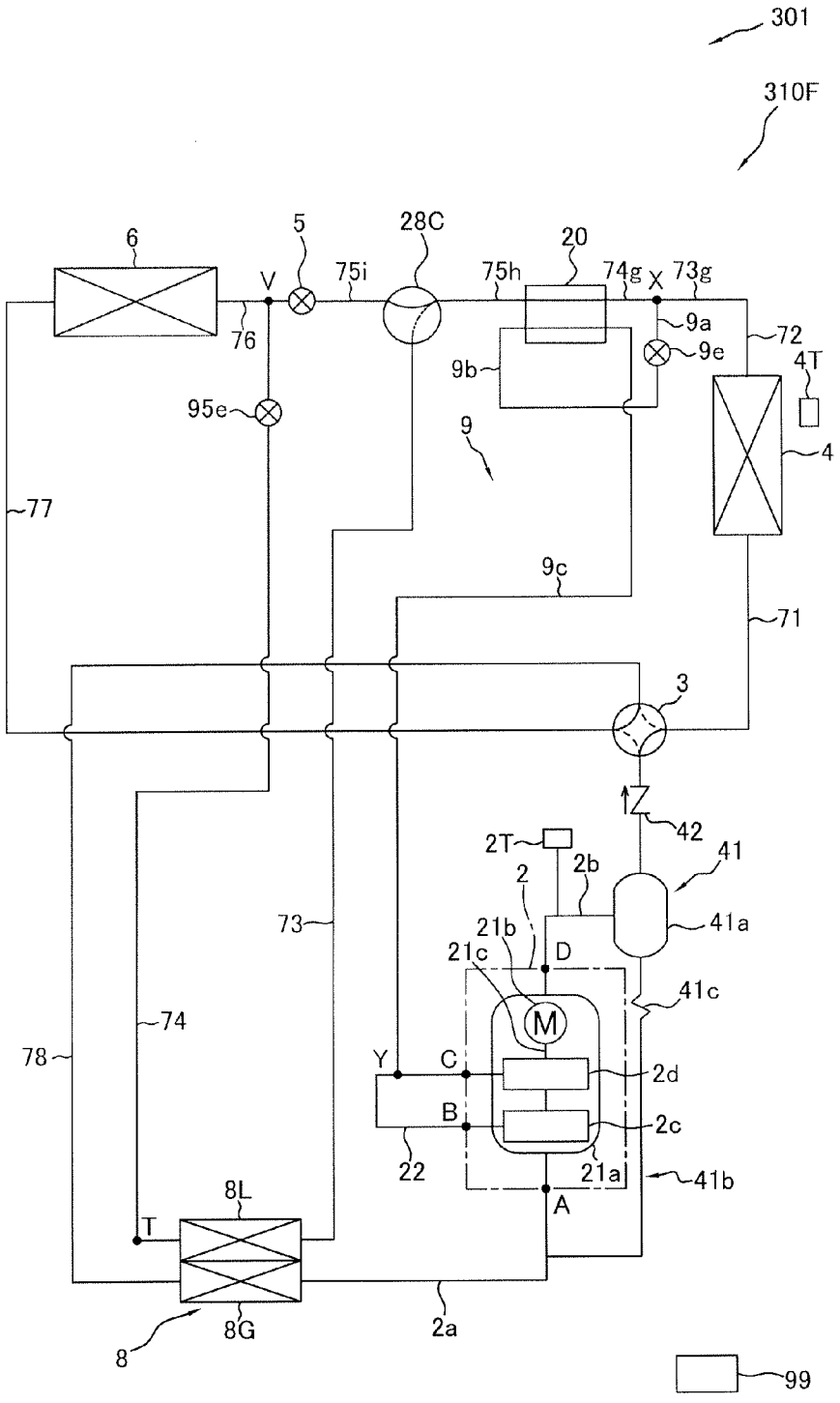
FIG. 22 is a general configuration diagram of an air conditioning apparatus pertaining to modification 8 of the third embodiment.

Further, as shown in FIG. 22, the present invention may also employ a refrigerant circuit 310F where the switching three-way valve 28C is placed between a connecting pipe 75*h* and a connecting pipe 75*i* extending from the expansion mechanism 5 and which is configured to allow the return refrigerant that has passed through the liquid-gas heat exchanger 8L to merge together at the merge point V in the connecting pipe 76 that interconnects the expansion mechanism 5 and the utilization-side heat exchanger 6.

In this case, the temperature of the refrigerant passing through the gas-side liquid-gas heat exchanger 8G is invariably lower than the temperature of the refrigerant whose pressure is reduced by the economizer expansion mechanism 9*e*, so by causing the refrigerant to pass through the liquid-side liquid-gas heat exchanger 8L after the refrigerant has cooled in the economizer heat exchanger 20, the efficiency with which the refrigerant is cooled before its pressure is reduced can be improved, and the specific enthalpy can be further lowered. Thus, the refrigerating capacity in the refrigeration cycle improves, and the coefficient of performance becomes good.

<3-11> Modification 9

Figure 23:
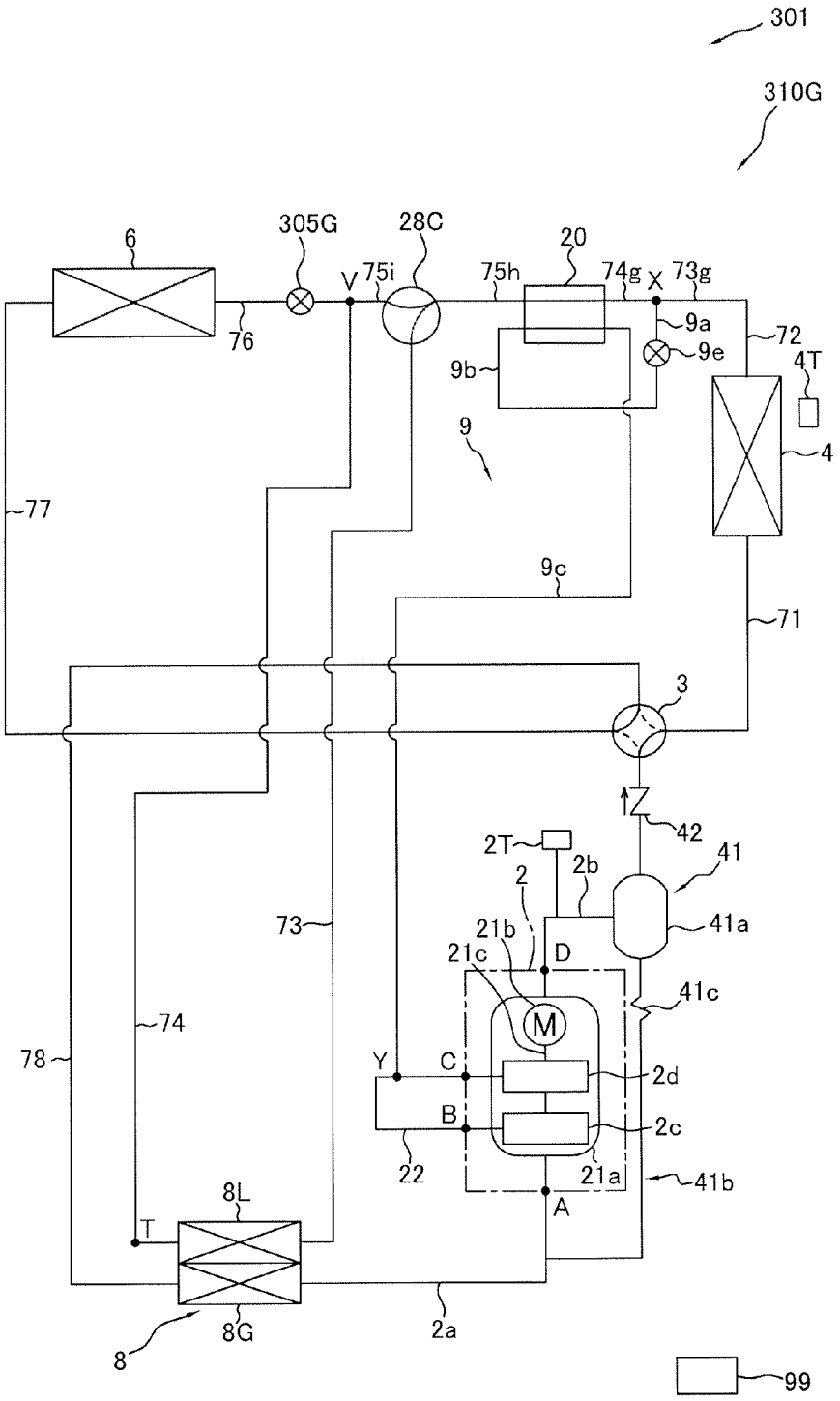
FIG. 23 is a general configuration diagram of an air conditioning apparatus pertaining to modification 9 of the third embodiment.

Moreover, as shown in FIG. 23, the present invention may also employ a refrigerant circuit 310E that has an expansion mechanism 305F in which the expansion mechanism 5 and the expansion mechanism 95*e* in the refrigerant circuit 310F are shared.

<3-12> Modification 10

Figure 24:
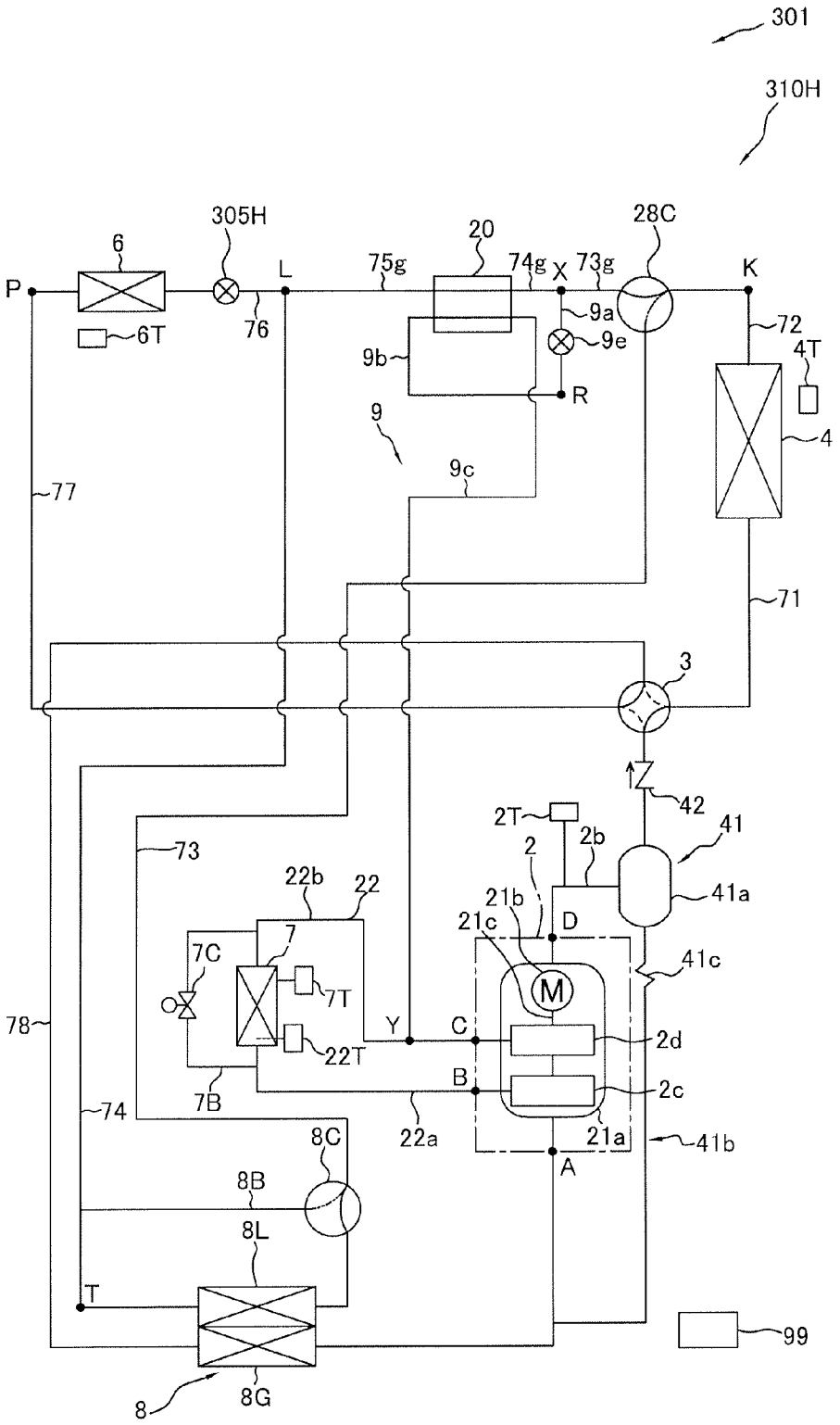
FIG. 24 is a general configuration diagram of an air conditioning apparatus pertaining to modification 10 of the third embodiment.

Further, as shown in FIG. 24, the present invention may also employ a refrigerant circuit 301H where an intermediate cooler 7 and an intermediate cooling bypass circuit 7B and an intermediate cooling bypass opening-and-closing valve 7C for bypassing this intermediate cooler 7 are disposed in the intermediate refrigerant pipe 22 and where a liquid-gas bypass pipe 8B and a liquid-gas three-way valve 8C for bypassing the liquid-side liquid-gas heat exchanger 8L are also disposed.

Here, there is obtained not only the effect of lowering the temperature of the refrigerant in the intermediate pipe 22 with the economizer circuit 9 but also the effect of lowering the temperature of the refrigerant with the intermediate cooler 7.

Further, the present invention may also be configured such that, by executing the heat exchange in the economizer heat exchanger 20 and at the same time causing the refrigerant to pass through the liquid-side liquid-gas heat exchanger 8L and causing the refrigerant to pass through the liquid-gas bypass pipe 8B, refrigerant on which heat exchange in the liquid-gas heat exchanger 8 is not performed can be brought into existence.

<3-13> Modification 11

In the above-described embodiment and modifications 1 to 10, refrigerant circuits in which only one compression mechanism 2 with which the refrigerant is compressed in two stages is disposed have been taken as examples and described.

However, the present invention is not limited to this. For example, the present invention may also employ a refrigerant circuit where a plurality of the compression mechanisms 2 that perform compression in two stages are disposed in parallel to each other.

Further, a plurality of the utilization-side heat exchangers 6 may also be placed in parallel to each other in the refrigerant circuit. In this case, the present invention may employ a refrigerant circuit where, in order to be able to control the quantity of the refrigerant supplied to each of the utilization-side heat exchangers 6, an expansion mechanism is placed just before each of the utilization-side heat exchangers so that the expansion mechanisms are also placed in parallel to each other.

<4> Other Embodiments

Embodiments of the present invention and modifications thereof have been described above on the basis of the drawings, but the specific configurations are not limited to these embodiments and the modifications thereof and can be altered in a scope that does not depart from the gist of the invention.

For example, in the above-described embodiments and modifications thereof, the present invention may also be applied to a so-called chiller-type air conditioning apparatus disposed with a secondary heat exchanger that uses water or brine as a heating source or a cooling source that performs heat exchange with the refrigerant flowing through the utilization-side heat exchanger 6 and which causes heat exchange to be performed between room air and the water or brine on which heat exchange has been performed in the utilization-side heat exchanger 6.

Further, the present invention can also be applied to types of refrigerating apparatus that differ from the chiller-type air conditioning apparatus described above, such as air conditioning apparatus dedicated to cooling.

Further, the refrigerant that works in a supercritical region is not limited to carbon dioxide, and ethylene, ethane, or nitric oxide may also be used.

Industrial Applicability

The refrigerating apparatus of the present invention is particularly useful when applied to a refrigerating apparatus that is equipped with a multistage compression-type compression element and uses, as a working refrigerant, a refrigerant that works including the process of a supercritical state, because with the refrigerating apparatus of the present invention, it becomes possible to improve, in a refrigerating apparatus using a refrigerant that works including the process of a supercritical state, its coefficient of performance while maintaining device reliability even when its load fluctuates.

What is claimed is:

1. A refrigerating apparatus where a working refrigerant reaches a supercritical state in at least part of a refrigeration cycle, the refrigerating apparatus comprising:

a first expansion mechanism arranged and configured to reduce pressure of refrigerant;

a second expansion mechanism arranged and configured to reduce pressure of refrigerant;

an evaporator connected to the first expansion mechanism, the evaporator being arranged and configured to evaporate refrigerant;

a first compression element arranged and configured to suck in, compress and discharge refrigerant;

a second compression element arranged and configured to suck in, further compress and discharge refrigerant that has been discharged from the first compression element;

a third refrigerant pipe arranged and configured to allow refrigerant that has been discharged from the first compression element to be sucked into the second compression element;

a radiator connected to a discharge side of the second compression element;

a first refrigerant pipe interconnecting the radiator and the first expansion mechanism;

a fourth refrigerant pipe branching from the first refrigerant pipe and extending to the second expansion mechanism;

a fifth refrigerant pipe extending from the second expansion mechanism to the third refrigerant pipe;

a second heat exchanger arranged and configured to cause heat exchange to be performed between refrigerant flowing through the first refrigerant pipe and refrigerant flowing through the fifth refrigerant pipe;

a temperature detector arranged and configured to detect a value of at least either one of a temperature of air around the evaporator, and a temperature of refrigerant discharged from at least either one of the first compression element and the second compression element;

a controller configured to control the second expansion mechanism to increase a quantity of the refrigerant passing therethrough when the value detected by the temperature detector is temperature of air, and the air temperature is lower than a predetermined tow-temperature air temperature, or when the value detected by the temperature detector is temperature of refrigerant, and the refrigerant temperature is higher than a predetermined high-temperature refrigerant temperature;

an external cooler arranged and configured to cool refrigerant passing through the third refrigerant pipe;

an external temperature detector arranged and configured to detect a temperature of a fluid passing through the external cooler; and a third refrigerant temperature detector arranged and configured to detect a temperature of refrigerant passing through the third refrigerant pipe, the controller being further configured to control the second expansion mechanism to increase the quantity of the refrigerant passing therethrough when a difference between the temperature detected by the external temperature detector and the temperature detected by the third refrigerant temperature detector has become less than a predetermined value.

2. The refrigerating apparatus according to claim 1, further comprising a first heat exchanger arranged and configured to cause heat exchange to be performed between refrigerant flowing through the first refrigerant pipe and refrigerant flowing through the second refrigerant pipe.

3. The refrigerating apparatus according to claim 2, further comprising a first heat exchange bypass pipe interconnecting one end side and an other end side of a portion of the first refrigerant pipe passing through the first heat exchanger; and a heat exchanger switching mechanism switchable between a state where the heat exchanger switching mechanism allows refrigerant to flow in the portion of the first refrigerant pipe passing through the first heat exchanger, and a state where the heat exchanger switching mechanism allows refrigerant to flow in the first heat exchange bypass pipe.

4. The refrigerating apparatus according to claim 3, wherein the controller is further configured to control the heat exchanger switching mechanism to increase a quantity of the refrigerant flowing through the portion of the first refrigerant pipe passing through the first heat exchanger when the value detected by the temperature detector is temperature of air, and the air temperature is higher than a predetermined high-temperature air temperature, or when the value detected by the temperature detector is temperature of refrigerant, and the refrigerant temperature is lower than a predetermined low-temperature refrigerant temperature.

5. The refrigerating apparatus according to claim 3, wherein the first compression element and the second compression element have a shared rotating shaft in order to perform compression work as a result of the shared rotating shaft being driven to rotate.

6. The refrigerating apparatus according to claim 4, wherein the first compression element and the second compression element have a shared rotating shaft in order to perform compression work as a result of the shared rotating shaft being driven to rotate.

7. The refrigerating apparatus according to claim 2, wherein the first compression element and the second compression element have a shared rotating shaft in order to perform compression work as a result of the shared rotating shaft being driven to rotate.

8. The refrigerating apparatus according to claim 2, wherein the working refrigerant is carbon dioxide.

9. The refrigerating apparatus according to claim 1, wherein the first compression element and the second compression element have a shared rotating shaft in order to perform compression work as a result of the shared rotating shaft being driven to rotate.

10. The refrigerating apparatus according to claim 1, wherein the working refrigerant is carbon dioxide.

11. The refrigerating apparatus according to claim 1, wherein the controller switches to an economizer non-utilization state when the temperature of refrigerant detected by the temperature detector is lower than a predetermined level, the second expansion valve being closed in the economizer non-utilization state.

12. The refrigerating apparatus according to claim 1, wherein the controller switches to an economizer non-utilization state when the temperature of air detected by the temperature detector is higher than a predetermined level, the second expansion valve being closed in the economizer non-utilization state.

13. The refrigerating apparatus according to claim 11, wherein the first compression element and the second compression element form parts of a capacity controllable two-stage compressor, and capacity of the compressor is controlled based on the temperature detected in the economizer non-utilization state until compression work reaches a predetermined value.

14. The refrigerating apparatus according to claim 12, wherein the first compression element and the second compression element form parts of a capacity controllable two-stage compressor, and capacity of the compressor is controlled based on the temperature detected in the economizer non-utilization state until compression work reaches a predetermined value.

* * * * *